US008295993B2

(12) United States Patent
Kumar

(10) Patent No.: US 8,295,993 B2
(45) Date of Patent: Oct. 23, 2012

(54) SYSTEM, METHOD, AND COMPUTER SOFTWARE CODE FOR OPTIMIZING SPEED REGULATION OF A REMOTELY CONTROLLED POWERED SYSTEM

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 1187 days.

(21) Appl. No.: 12/126,858

(22) Filed: May 24, 2008

(65) Prior Publication Data

US 2008/0312775 A1 Dec. 18, 2008

Related U.S. Application Data

(63) Continuation-in-part of application No. 11/765,443, filed on Jun. 19, 2007, and a continuation-in-part of application No. 11/669,364, filed on Jan. 31, 2007, and a continuation-in-part of application No. 11/385,354, filed on Mar. 20, 2006, application No. 12/126,858, which is a continuation-in-part of application No. 12/061,444, filed on Apr. 2, 2008.

(60) Provisional application No. 60/894,039, filed on Mar. 9, 2007, provisional application No. 60/939,852, filed on May 24, 2007, provisional application No. 60/849,100, filed on Oct. 2, 2006, provisional application No. 60/850,885, filed on Oct. 10, 2006, provisional application No. 60/942,559, filed on Jun. 7, 2007.

(51) Int. Cl.

| | |
|---|---|
| ***G05D 1/00*** | (2006.01) |
| ***G06F 7/00*** | (2006.01) |
| ***G06F 17/00*** | (2006.01) |

(52) U.S. Cl. ..... 701/2; 701/19; 701/20; 701/36; 701/100; 701/121; 701/427; 701/430; 701/448; 701/468

(58) Field of Classification Search ..... 701/19, 701/20, 33, 36, 117, 204, 211, 213, 2, 100, 701/121, 427, 430, 448, 468; 340/993, 995.19, 340/995.12, 825.69

See application file for complete search history.

(56) References Cited

U.S. PATENT DOCUMENTS

| | | | |
|---|---|---|---|
| 3,519,805 | A | 7/1970 | Thorne-Booth |
| 3,650,216 | A | 3/1972 | Harwick et al. |
| 3,655,962 | A | 4/1972 | Koch |
| 3,865,042 | A | 2/1975 | DePaola et al. |
| 4,005,838 | A | 2/1977 | Grundy |
| 4,041,283 | A | 8/1977 | Mosier |
| 4,042,810 | A | 8/1977 | Mosher |
| 4,181,943 | A | 1/1980 | Mercer, Sr. |

(Continued)

FOREIGN PATENT DOCUMENTS

| | | |
|---|---|---|
| EP | 1 297 982 | 4/2003 |

*Primary Examiner* — Khoi Tran
*Assistant Examiner* — Jorge Peche
(74) *Attorney, Agent, or Firm* — GE Global Patent Operation; John A. Kramer

(57) ABSTRACT

A system for operating a remotely controlled powered system, the system including a feedfoward gains element configured to provide information to the remotely controlled powered system to establish a velocity, and a feedback gains element configured to provide information from the remotely controlled powered system to the feedforward gains element. A method and a computer software code are further disclosed for operating the remotely controlled powered system.

29 Claims, 18 Drawing Sheets

U.S. PATENT DOCUMENTS 4,253,399 A 3/1981 Spigarelli
4,279,395 A 7/1981 Boggio et al.
4,344,364 A 8/1982 Nickles et al.
4,401,035 A 8/1983 Spigarelli et al.
4,561,057 A 12/1985 Haley, Jr. et al.
4,602,335 A 7/1986 Perlmutter
4,711,418 A 12/1987 Aver, Jr. et al.
4,735,385 A 4/1988 Nickles et al.
4,794,548 A 12/1988 Lynch et al.
4,827,438 A 5/1989 Nickles et al.
4,853,883 A 8/1989 Nickles et al.
5,109,343 A 4/1992 Budway
5,398,894 A 3/1995 Pascoe
5,437,422 A 8/1995 Newman
5,440,489 A 8/1995 Newman
5,676,059 A 10/1997 Alt
5,744,707 A 4/1998 Kull
5,758,299 A 5/1998 Sandborg et al.
5,785,392 A 7/1998 Hart
5,828,979 A 10/1998 Polivka et al.
5,950,967 A 9/1999 Montgomery
6,112,142 A 8/2000 Shockley et al.
6,125,311 A 9/2000 Lo
6,144,901 A 11/2000 Nickles et al.
6,269,034 B1 7/2001 Shibuya
6,308,117 B1 10/2001 Ryland et al.
6,441,570 B1 * 8/2002 Grubba et al. ..... 318/3
6,487,488 B1 11/2002 Peterson, Jr. et al.
6,505,103 B1 1/2003 Howell et al.
6,516,727 B2 2/2003 Kraft
6,591,758 B2 7/2003 Kumar
6,609,049 B1 8/2003 Kane et al.
6,612,245 B2 9/2003 Kumar et al.
6,612,246 B2 9/2003 Kumar
6,615,118 B2 9/2003 Kumar
6,631,322 B1 * 10/2003 Arthur et al. ..... 701/454
6,691,957 B2 2/2004 Hess, Jr. et al.
6,694,231 B1 2/2004 Rezk
6,732,023 B2 5/2004 Sugita et al.
6,763,291 B1 7/2004 Houpt et al.
6,789,005 B2 9/2004 Hawthorne
6,810,312 B2 10/2004 Jammu et al.
6,824,110 B2 11/2004 Kane et al.
6,845,953 B2 1/2005 Kane et al.
6,853,888 B2 2/2005 Kane et al.
6,853,890 B1 * 2/2005 Horst et al. ..... 701/20
6,856,865 B2 2/2005 Hawthorne
6,863,246 B2 3/2005 Kane et al.
6,865,454 B2 3/2005 Kane et al.
6,903,658 B2 6/2005 Kane et al.
6,915,191 B2 7/2005 Kane et al.
6,922,619 B2 7/2005 Baig et al.
6,957,131 B2 10/2005 Kane et al.
6,978,195 B2 12/2005 Kane et al.
6,980,894 B1 12/2005 Gordon et al.
6,996,461 B2 2/2006 Kane et al.
7,021,588 B2 4/2006 Hess, Jr. et al.
7,021,589 B2 4/2006 Hess, Jr. et al.
7,024,289 B2 4/2006 Kane et al.
7,036,774 B2 5/2006 Kane et al.
7,079,926 B2 7/2006 Kane et al.
7,092,800 B2 8/2006 Kane et al.
7,092,801 B2 8/2006 Kane et al.
7,770,847 B1 * 8/2010 Severson ..... 246/3
2002/0059075 A1 5/2002 Schick et al.
2002/0096081 A1 7/2002 Kraft
2003/0213875 A1 11/2003 Hess, Jr. et al.
2004/0133315 A1 7/2004 Kumar et al.
2004/0245410 A1 12/2004 Kisak et al.
2005/0065674 A1 3/2005 Houpt et al.
2005/0120904 A1 6/2005 Kumar et al.
2005/0285552 A1 * 12/2005 Grubba et al. ..... 318/268
2006/0187086 A1 * 8/2006 Quintos ..... 340/936
2007/0219680 A1 9/2007 Kumar et al.
2007/0233364 A1 10/2007 Kumar
2008/0041267 A1 * 2/2008 Denen et al. ..... 105/1.5
2008/0164078 A1 * 7/2008 Rhodes et al. ..... 180/6.48
2009/0076664 A1 * 3/2009 McCabe et al. ..... 701/2
2009/0266943 A1 * 10/2009 Kumar et al. ..... 246/28 R
2009/0299555 A1 * 12/2009 Houpt et al. ..... 701/19
2010/0114404 A1 * 5/2010 Donnelly ..... 701/2

* cited by examiner

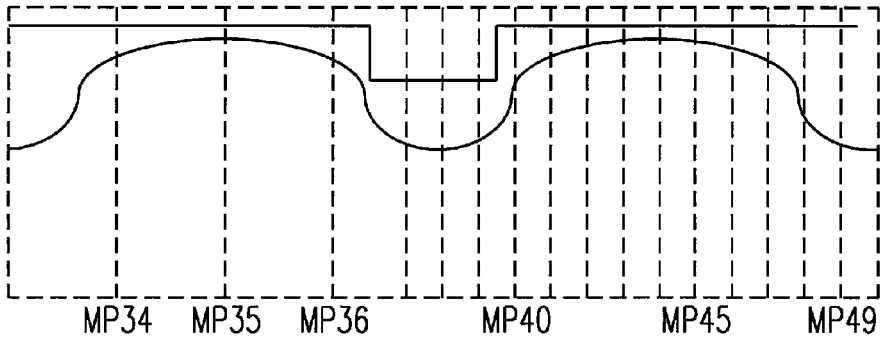
FIG. 15
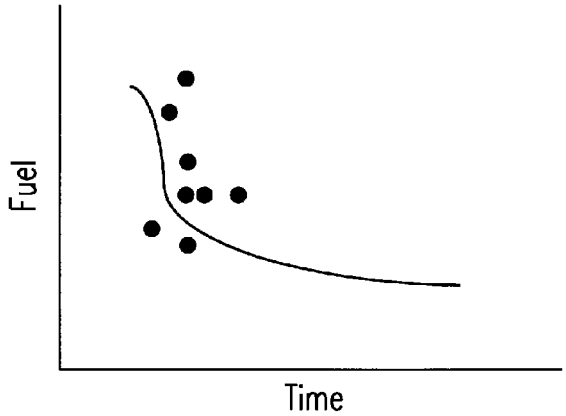
FIG. 16
FIG. 20
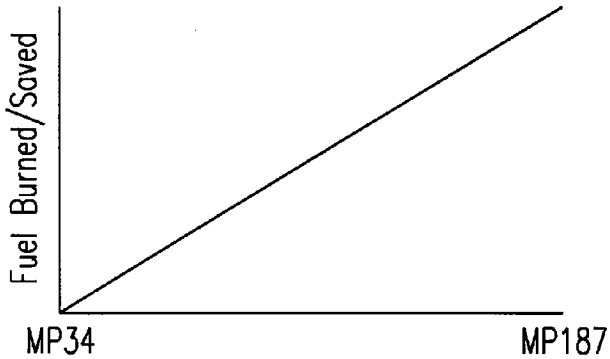

SYSTEM, METHOD, AND COMPUTER SOFTWARE CODE FOR OPTIMIZING SPEED REGULATION OF A REMOTELY CONTROLLED POWERED SYSTEM

CROSS-REFERENCE TO RELATED APPLICATIONS

This application claims priority to and is a Continuation-In-Part of U.S. application Ser. No. 11/765,443 filed Jun. 19, 2007, which claims priority to U.S. Provisional Application No. 60/894,039 filed Mar. 9, 2007, and U.S. Provisional Application No. 60/939,852 filed May 24, 2007, and incorporated herein by reference in its entirety.

U.S. application Ser. No. 11/765,443 claims priority to and is a Continuation-In-Part of U.S. application Ser. No. 11/669,364 filed Jan. 31, 2007, which claims priority to U.S. Provisional Application No. 60/849,100 filed Oct. 2, 2006, and U.S. Provisional Application No. 60/850,885 filed Oct. 10, 2006, and incorporated herein by reference in its entirety.

U.S. application Ser. No. 11/669,364 claims priority to and is a Continuation-In-Part of U.S. application Ser. No. 11/385,354 filed Mar. 20, 2006, and incorporated herein by reference in its entirety.

This application also claims priority to U.S. Provisional Application No. 60/942,559 filed Jun. 7, 2007, and incorporated herein by reference in its entirety.

This application also claims priority to and is a Continuation-In-Part of U.S. application Ser. No. 12/061,444 filed Apr. 2, 2008, and incorporated herein by reference in its entirety.

This application is based on and claims priority to U.S. Provisional Application No. 60/939,950 filed May 23, 2007, and incorporated herein by reference in its entirety.

BACKGROUND OF THE INVENTION

This invention relates to a powered system, such as a train, an off-highway vehicle, a marine vessel, a transport vehicle, an agriculture vehicle, and/or a stationary powered system and, more particularly to a system, method and computer software code for controlling a remote controlled power system to improve efficiency of its operation.

Some powered systems such as, but not limited to, off-highway vehicles, marine diesel powered propulsion plants, stationary diesel powered systems, transport vehicles such as transport buses, agricultural vehicles, and rail vehicle systems or trains, are typically powered by one or more diesel power units, or diesel-fueled power generating units. With respect to rail vehicle systems, a diesel power unit is usually a part of at least one locomotive powered by at least one diesel internal combustion engine and the train further includes a plurality of rail cars, such as freight cars. Usually more than one locomotive is provided, wherein the locomotives are considered a locomotive consist. A locomotive consist is a group of locomotives that operate together in operating a train. Locomotives are complex systems with numerous subsystems, with each subsystem being interdependent on other subsystems.

An operator is usually aboard a locomotive to insure the proper operation of the locomotive, and when there is a locomotive consist, the operator is usually aboard a lead locomotive. In addition to ensuring proper operations of the locomotive or locomotive consist, the operator also is responsible for determining operating speeds of the train and forces within the train that the locomotives are part of. To perform this function, the operator generally must have extensive experience with operating the locomotive and various trains over the specified terrain. This knowledge is needed to comply with prescribeable operating parameters, such as speeds, emissions, and the like that may vary with the train location along the track. Moreover, the operator is also responsible for ensuring that in-train forces remain within acceptable limits.

In marine applications, an operator is usually aboard a marine vessel to ensure the proper operation of the vessel, and when there is a vessel consist, the lead operator is usually aboard a lead vessel. As with the locomotive example cited above, a vessel consist is a group of vessels that operate together in operating a combined mission. In addition to ensuring proper operations of the vessel, or vessel consist, the lead operator also is responsible for determining operating speeds of the consist and forces within the consist that the vessels are part of. To perform this function, the operator generally must have extensive experience with operating the vessel and various consists over the specified waterway or mission. This knowledge is needed to comply with prescribeable operating speeds and other mission parameters that may vary with the vessel location along the mission. Moreover, the operator is also responsible for assuring mission forces and location remain within acceptable limits.

In the case of multiple diesel power powered systems, which by way of example and limitation, may reside on a single vessel, power plant or vehicle or power plant sets, an operator is usually in command of the overall system to ensure the proper operation of the system, and when there is a system consist, the operator is usually aboard a lead system. Defined generally, a system consist is a group of powered systems that operate together in meeting a mission. In addition to ensuring proper operations of the single system, or system consist, the operator also is responsible for determining operating parameters of the system set and forces within the set that the system are part of. To perform this function, the operator generally must have extensive experience with operating the system and various sets over the specified space and mission. This knowledge is needed to comply with prescribeable operating parameters and speeds that may vary with the system set location along the route. Moreover, the operator is also responsible for ensuring that in-set forces remain within acceptable limits.

Not all locomotives utilize an operator to control it from within the locomotive. Remotely controlled locomotives (RCL) exist. A RCL is a locomotive that, through use of a radio transmitter and receiver system, can be operated by a person not physically located at the controls within the confines of the locomotive cab. The systems are designed to be fail-safe; that is, if communication is lost, the locomotive is brought to a stop automatically. Other power systems may be operated remotely at times as well depending on an intended purpose.

A typical RCL system has an operator control unit, which is in wireless communication with a locomotive control unit which is on-board a RCL. The operator control unit is used by an operator to control the RCL. The locomotive control unit may include a transmitter for transmitting locomotive information, such as a condition sensed by one or more sensors to the operator control unit. The locomotive control unit is configured to control the throttle and braking systems of the RCL.

A RCL may be used to traverse various terrains at speeds determined by the operator who is remotely controlling the RCL. However when using the RCL as a speed regular, terrain information is not available. Therefore, the speed regulator performance is not optimum. Operators could more effectively operate a RCL if information pertaining to terrain information is available. Therefore operators as well as owners of trains being operated remotely would benefit from having such systems operated more effectively where improved emissions and performance are realized.

BRIEF DESCRIPTION OF THE INVENTION

Exemplary embodiments of his invention disclose a system, method and computer software code for operating a remotely operated power system, such as but not limited to a remote control locomotive.

A method for training an operator to control a powered system is disclosed. The method includes operating the powered system with an autonomous controller, and informing an operator of a change in operation of the powered system as the change in operation occurs.

In another exemplary embodiment, a method for training an operator to control a powered system, the method including operating the powered system with an autonomous controller. The autonomous controller is disengaged so that an operator may control the powered system.

In another exemplary embodiment a method for training an operator to control a powered system is disclosed. The method includes operating the powered system with an autonomous controller, and providing an input device for an operator to simulate operating the powered system as the autonomous controller operates the powered system.

In another exemplary embodiment a method for training an operator to control a powered system is disclosed. The method includes providing a powered system in a stationary condition with a manual control device disengaged from controlling the powered system. A mission is communicated to an operator. Operation of the powered system is simulated responsive to the mission with the manual control device.

In another exemplary embodiment a training system for instructing an operator to control a powered system is disclosed. The training system includes a controller configured to autonomously control a powered system. An information providing device is provided which is configured to provide information to an operator responsive to the controller operating the powered system.

A computer software code operating within a processor and storable on a computer readable media for training an operator to control a powered system is further disclosed. The computer software code includes computer software module for operating the powered system with an autonomous controller, and a computer software module for informing an operator of a change in operation of the powered system as the change in operation occurs.

A method for training an operator to control operation of a train having at least one locomotive is further disclosed. The method includes operating the train having at least one locomotive with an autonomous controller during a mission. A throttle control and/or a brake control are provided for the operator to simulate operating the train as the autonomous controller actually operates the train. A determination is made that an input from the throttle control and/or the brake control has been made by the operator to simulate operating the train as the autonomous controller actually operates the train. A comparison is between the at least one input and the at least one action made by the autonomous controller as the autonomous controller actually operates the powered system.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, exemplary embodiments of the invention will be described and explained with additional specificity and detail through the use of the accompanying drawings in which:

FIG. 15 depicts an illustration of a portion of the dynamic display;

FIG. 16 depicts another illustration for a portion of the dynamic display;

FIG. 20 depicts another illustration for a portion of the dynamic display screen;

DETAILED DESCRIPTION OF THE INVENTION

Figure 1:
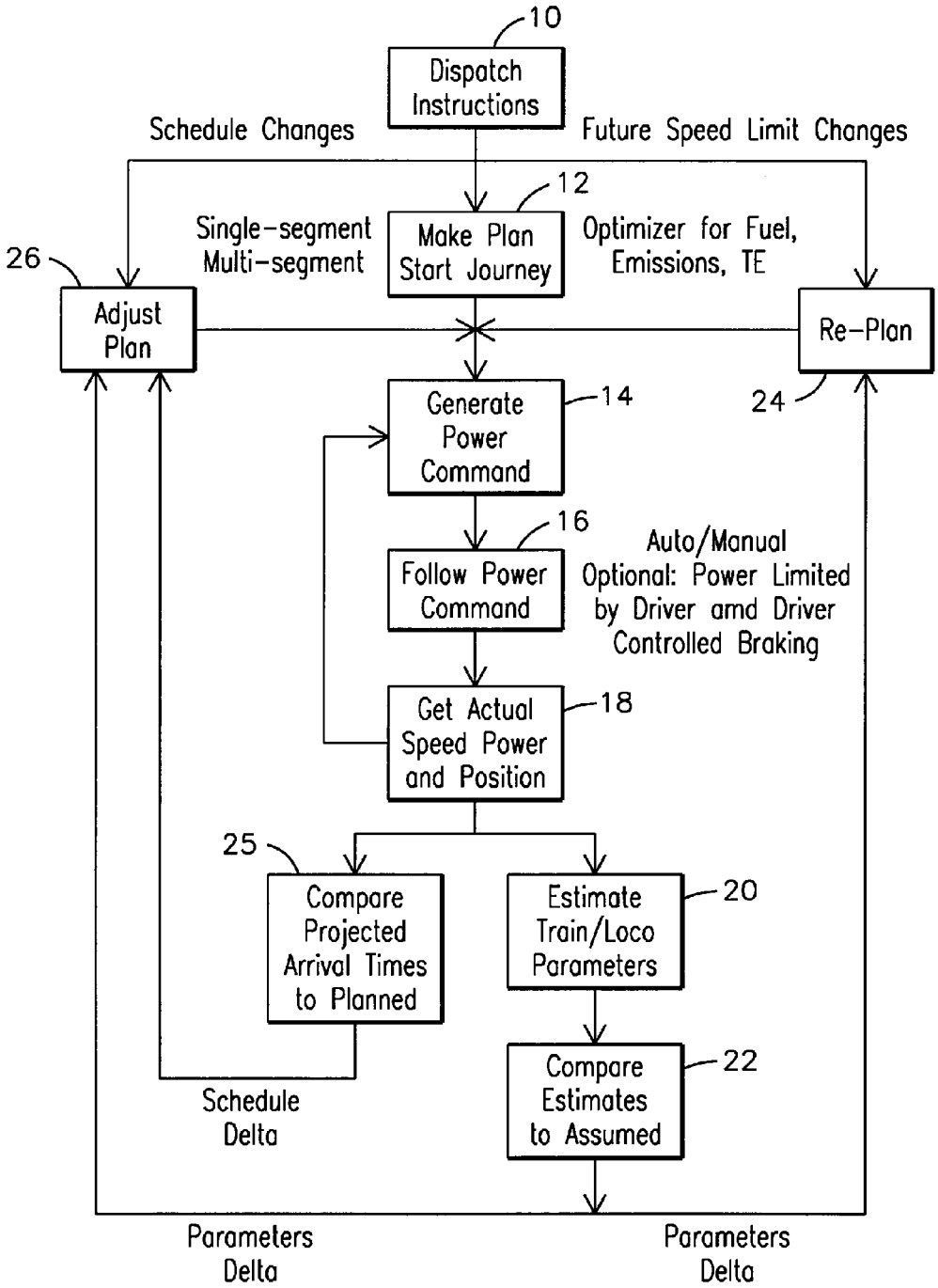
FIG. 1 depicts an exemplary illustration of a flow chart trip optimization.

Reference will now be made in detail to the embodiments consistent with the invention, examples of which are illustrated in the accompanying drawings. Wherever possible, the same reference numerals used throughout the drawings refer to the same or like parts.

Though exemplary embodiments of the present invention are described with respect to rail vehicles, or railway transportation systems, specifically trains and locomotives having diesel engines, exemplary embodiments of the invention are also applicable for other uses, such as but not limited to off-highway vehicles, marine vessels, stationary units, agricultural vehicles, and transport buses, each which may use at least one diesel engine, or diesel internal combustion engine. Towards this end, when discussing a specified mission, this includes a task or requirement to be performed by the powered system.

Therefore, with respect to railway, marine, transport vehicles, agricultural vehicles, or off-highway vehicle applications this may refer to the movement of the system from a present location to a destination. In the case of stationary applications, such as but not limited to a stationary power generating station or network of power generating stations, a specified mission may refer to an amount of wattage (e.g., MW/hr) or other parameter or requirement to be satisfied by the diesel powered system. Likewise, operating condition of the diesel-fueled power generating unit may include one or more of speed, load, fueling value, timing, etc. Furthermore, though diesel powered systems are disclosed, those skilled in the art will readily recognize that embodiments of the invention may also be utilized with non-diesel powered systems, such as but not limited to natural gas powered systems, biodiesel powered systems, etc.

Furthermore, as disclosed herein such non-diesel powered systems, as well as diesel powered systems, may include multiple engines, other power sources, and/or additional power sources, such as, but not limited to, battery sources, voltage sources (such as but not limited to capacitors), chemical sources, pressure based sources (such as but not limited to spring and/or hydraulic expansion), current sources (such as but not limited to inductors), inertial sources (such as but not limited to flywheel devices), gravitational-based power sources, and/or thermal-based power sources.

In one exemplary example involving marine vessels, a plurality of tugs may be operating together where all are moving the same larger vessel, where each tug is linked in time to accomplish the mission of moving the larger vessel. In another exemplary example a single marine vessel may have a plurality of engines. Off-Highway Vehicle (OHV) applications may involve a fleet of vehicles that have a same mission to move earth, from location A to location B, where each OHV is linked in time to accomplish the mission. With respect to a stationary power generating station, a plurality of stations may be grouped together for collectively generating power for a specific location and/or purpose. In another exemplary embodiment, a single station is provided, but with a plurality of generators making up the single station. In one exemplary example involving locomotive vehicles, a plurality of diesel powered systems may be operated together where all are moving the same larger load, where each system is linked in time to accomplish the mission of moving the larger load. In another exemplary embodiment a locomotive vehicle may have more than one diesel powered system.

Additionally, though exemplary examples provided herein are also directed to remote control locomotives, these examples are also applicable to other powered systems that are remotely controlled.

Exemplary embodiments of the invention solve problems in the art by providing a system, method, and computer implemented method, such as a computer software code, for controlling a remote controlled power system to improve efficiency of its operation. With respect to locomotives, exemplary embodiments of the present invention are also operable when the locomotive consist is in distributed power operations.

Persons skilled in the art will recognize that an apparatus, such as a data processing system, including a CPU, memory, I/O, program storage, a connecting bus, and other appropriate components, could be programmed or otherwise designed to facilitate the practice of the method of the invention. Such a system would include appropriate program means for executing the method of the invention.

Also, an article of manufacture, such as a pre-recorded disk or other similar computer program product, for use with a data processing system, could include a storage medium and program means recorded thereon for directing the data processing system to facilitate the practice of the method of the invention. Such apparatus and articles of manufacture also fall within the spirit and scope of the invention.

Broadly speaking, a technical effect is to control a remote controlled power system where terrain information is used to optimize speed regulation. To facilitate an understanding of the exemplary embodiments of the invention, it is described hereinafter with reference to specific implementations thereof. Exemplary embodiments of the invention may be described in the general context of computer-executable instructions, such as program modules, being executed by any device, such as but not limited to a computer, designed to accept data, perform prescribed mathematical and/or logical operations usually at high speed, where results of such operations may or may not be displayed. Generally, program modules include routines, programs, objects, components, data structures, etc. that performs particular tasks or implement particular abstract data types. For example, the software programs that underlie exemplary embodiments of the invention can be coded in different programming languages, for use with different devices, or platforms. In the description that follows, examples of the invention may be described in the context of a web portal that employs a web browser. It will be appreciated, however, that the principles that underlie exemplary embodiments of the invention can be implemented with other types of computer software technologies as well.

Moreover, those skilled in the art will appreciate that exemplary embodiments of the invention may be practiced with other computer system configurations, including hand-held devices, multiprocessor systems, microprocessor-based or programmable consumer electronics, minicomputers, mainframe computers, and the like. Exemplary embodiments of the invention may also be practiced in distributed computing environments where tasks are performed by remote processing devices that are linked through a communications network. In a distributed computing environment, program modules may be located in both local and remote computer storage media including memory storage devices. These local and remote computing environments may be contained entirely within the locomotive, or adjacent locomotives in a consist, or off-board in wayside or central offices where wireless communication is used.

Throughout this document the term locomotive consist is used. As used herein, a locomotive consist may be described as having one or more locomotives in succession, connected together so as to provide motoring and/or braking capability. The locomotives are connected together where no train cars are in between the locomotives. The train can have more than one locomotive consist in its composition. Specifically, there can be a lead consist and one or more remote consists, such as midway in the line of cars and another remote consist at the end of the train. Each locomotive consist may have a first locomotive and trail locomotive(s). Though a first locomotive is usually viewed as the lead locomotive, those skilled in the art will readily recognize that the first locomotive in a multi locomotive consist may be physically located in a physically trailing position. Though a locomotive consist is usually viewed as involving successive locomotives, those skilled in the art will readily recognize that a consist group of locomotives may also be recognized as a consist even when at least a car separates the locomotives, such as when the locomotive consist is configured for distributed power operation, wherein throttle and braking commands are relayed from the lead locomotive to the remote trains by a radio link or physical cable. Towards this end, the term locomotive consist should be not be considered a limiting factor when discussing multiple locomotives within the same train.

As disclosed herein, the idea of a consist may also be applicable when referring to diesel powered systems such as, but not limited to, marine vessels, off-highway vehicles, transportation vehicles, agricultural vehicles, and/or stationary power plants, that operate together so as to provide motoring, power generation, and/or braking capability. Therefore, even though the term locomotive consist is used herein in regards to certain illustrative embodiments, this term may also apply to other powered systems. Similarly, sub-consists may exist. For example, the diesel powered system may have more than one diesel-fueled power generating unit. For example, a power plant may have more than one diesel electric power unit where optimization may be at the sub-consist level. Likewise, a locomotive may have more than one diesel power unit.

Referring now to the drawings, embodiments of the present invention will be described. Exemplary embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

FIG. 1 depicts an exemplary illustration of a flow chart of an exemplary embodiment of the present invention. As illustrated, instructions are input specific to planning a trip either on board or from a remote location, such as a dispatch center 10. Such input information includes, but is not limited to, train position, consist description (such as locomotive models), locomotive power description, performance of locomotive traction transmission, consumption of engine fuel as a function of output power, cooling characteristics, the intended trip route (e.g., effective track grade and curvature as function of milepost, or an "effective grade" component to reflect curvature following standard railroad practices), the train represented by car makeup and loading together with effective drag coefficients, trip desired parameters including, but not limited to, start time and location, end location, desired travel time, crew (user and/or operator) identification, crew shift expiration time, and route.

This data may be provided to the locomotive 42 in a number of ways, such as, but not limited to, an operator manually entering this data into the locomotive 42 via an onboard display, inserting a memory device such as a "hard card" and/or USB drive containing the data into a receptacle aboard the locomotive, and transmitting the information via wireless communication from a central or wayside location 41, such as a track signaling device and/or a wayside device, to the locomotive 42. Locomotive 42 and train 31 load characteristics (e.g., drag) may also change over the route (e.g., with altitude, ambient temperature and condition of the rails and rail-cars), and the plan may be updated to reflect such changes as needed by any of the methods discussed above and/or by real-time autonomous collection of locomotive/train conditions. This includes for example, changes in locomotive or train characteristics detected by monitoring equipment on or off board the locomotive(s) 42.

The track signal system determines the allowable speed of the train. There are many types of track signal systems and operating rules associated with each of the signals. For example, some signals have a single light (on/off), some signals have a single lens with multiple colors, and some signals have multiple lights and colors. These signals can indicate that the track is clear and the train may proceed at a maximum allowable speed. They can also indicate that a reduced speed or stop is required. This reduced speed may need to be achieved immediately, or at a certain location (e.g., prior to the next signal or crossing).

The signal status is communicated to the train and/or operator through various means. Some systems have circuits in the track and inductive pick-up coils on the locomotives. Other systems have wireless communications systems. Signal systems can also require the operator to visually inspect the signal and take the appropriate actions.

The track signaling system may interface with the onboard signal system and adjust the locomotive speed according to the inputs and the appropriate operating rules. For signal systems that require the operator to visually inspect the signal status, the operator screen will present the appropriate signal options for the operator to enter based on the train's location. The type of signal systems and operating rules, as a function of location, may be stored in an onboard database 63.

Based on the specification data input into the exemplary embodiment of the present invention, an optimal plan which minimizes fuel use and/or emissions produced subject to speed limit constraints along the route with desired start and end times is computed to produce a trip profile 12. The profile contains the optimal speed and power (notch) settings the train is to follow, expressed as a function of distance and/or time, and such train operating limits, including but not limited to, the maximum notch power and brake settings, and speed limits as a function of location, and the expected fuel used and emissions generated. In an exemplary embodiment, the value for the notch setting is selected to obtain throttle change decisions about once every 10 to 30 seconds. Those skilled in the art will readily recognize that the throttle change decisions may occur at a longer or shorter duration, if needed and/or desired to follow an optimal speed profile. In a broader sense, it should be evident to ones skilled in the art that the profiles provide power settings for the train, either at the train level, consist level, and/or individual train level. Power comprises braking power, motoring power, and airbrake power. In another preferred embodiment, instead of operating at the traditional discrete notch power settings, the exemplary embodiment of the present invention is able to select a continuous power setting determined as optimal for the profile selected. Thus, for example, if an optimal profile specifies a notch setting of 6.8, instead of operating at notch setting 7 (assuming discreet notch settings such as 6, 7, 8, and so on), the locomotive 42 can operate at 6.8. Allowing such intermediate power settings may bring additional efficiency benefits as described below.

The procedure used to compute the optimal profile can be any number of methods for computing a power sequence that drives the train 31 to minimize fuel and/or emissions subject to locomotive operating and schedule constraints, as summarized below. In some cases the required optimal profile may be close enough to one previously determined, owing to the similarity of the train configuration, route and environmental conditions. In these cases it may be sufficient to look up the driving trajectory within a database 63 and attempt to follow it. When no previously computed plan is suitable, methods to compute a new one include, but are not limited to, direct calculation of the optimal profile using differential equation models which approximate the train physics of motion. The setup involves selection of a quantitative objective function, commonly a weighted sum (integral) of model variables that correspond to rate of fuel consumption and emissions generation plus a term to penalize excessive throttle variation.

An optimal control formulation is set up to minimize the quantitative objective function subject to constraints including but not limited to, speed limits and minimum and maximum power (throttle) settings and maximum cumulative and instantaneous emissions. Depending on planning objectives at any time, the problem may be implemented flexibly to minimize fuel subject to constraints on emissions and speed limits, or to minimize emissions, subject to constraints on fuel use and arrival time. It is also possible to implement, for example, a goal to minimize the total travel time without constraints on total emissions or fuel use where such relaxation of constraints would be permitted or required for the mission.

Throughout the document exemplary equations and objective functions are presented for minimizing locomotive fuel consumption. These equations and functions are for illustration only as other equations and objective functions can be employed to optimize fuel consumption or to optimize other locomotive/train operating parameters.

Mathematically, the problem to be solved may be stated more precisely. The basic physics are expressed by:

$$\frac{dx}{dt} = v;\ x(0) = 0.0;\ x(T_f) = D$$

$$\frac{dv}{dt} = T_e(u, v) - G_a(x) - R(v);\ v(0) = 0.0;\ v(T_f) = 0.0$$

where x is the position of the train, v its velocity and t is time (in miles, miles per hour, and minutes or hours, as appropriate) and u is the notch (throttle) command input. Further, D denotes the distance to be traveled, $T_f$ the desired arrival time at distance D along the track, $T_e$ is the tractive effort produced by the locomotive consist, $G_a$ is the gravitational drag which depends on the train length, train makeup, and terrain on which the train is located, and R is the net speed dependent drag of the locomotive consist and train combination. The initial and final speeds can also be specified, but without loss of generality are taken to be zero here (e.g., train stopped at beginning and end). Finally, the model is readily modified to include other important dynamics such the lag between a change in throttle, u, and the resulting tractive effort or braking. Using this model, an optimal control formulation is set up to minimize the quantitative objective function subject to constraints including but not limited to, speed limits and minimum and maximum power (throttle) settings. Depending on planning objectives at any time, the problem may be set up flexibly to minimize fuel subject to constraints on emissions and speed limits, or to minimize emissions, subject to constraints on fuel use and arrival time.

It is also possible to implement, for example, a goal to minimize the total travel time without constraints on total emissions or fuel use where such relaxation of constraints would be permitted or required for the mission. All these performance measures can be expressed as a linear combination of any of the following:

$$\min_{u(t)} \int_0^{T_f} F(u(t))dt \text{ - Minimize total fuel consumption}$$

$$\min_{u(t)} T_f \text{ - Minimize Travel Time}$$

$$\min_{u_i} \sum_{i=2}^{n_d} (u_i - u_{i-1})^2 \text{ - Minimize notch jockeying}$$

(piecewise constant input)

$$\min_{u(t)} \int_0^{T_f} \left(\frac{du}{dt}\right)^2 dt \text{ - Minimize notch jockeying(continuous input)}$$

Replace the fuel term F in (1) with a term corresponding to emissions production. For example for emissions $$\min_{u(t)} \int_0^{T_f} E(u(t))dt$$

—Minimize total emissions production. In this equation E is the quantity of emissions in gm/hphr for each of the notches (or power settings). In addition a minimization could be done based on a weighted total of fuel and emissions.

A commonly used and representative objective function is thus:

$$\min_{u(t)} \alpha_1 \int_0^{T_f} F(u(t))dt + \alpha_3 T_f + \alpha_2 \int_0^{T_f} \left(\frac{du}{dt}\right)^2 dt \qquad \text{(OP)}$$

The coefficients of the linear combination depend on the importance (weight) given to each of the terms. Note that in equation (OP), u(t) is the optimizing variable that is the continuous notch position. If discrete notch is required, e.g. for older locomotives, the solution to equation (OP) is discretized, which may result in lower fuel savings. Finding a minimum time solution ($\alpha_1$, set to zero and $\alpha_2$ set to zero or a relatively small value) is used to find a lower bound for the achievable travel time ($T_f = T_{fmin}$). In this case, both u(t) and $T_f$ are optimizing variables. In one embodiment, the equation (OP) is solved for various values of $T_f$ with $T_f > T_{fmin}$ with $\alpha_3$ set to zero. In this latter case, $T_f$ is treated as a constraint.

For those familiar with solutions to such optimal problems, it may be necessary to adjoin constraints, e.g. the speed limits along the path:

$$0 \leqq v \leqq SL(x) \qquad \text{i.}$$

or when using minimum time as the objective, that an end point constraint must hold, e.g., total fuel consumed must be less than what is in the tank, e.g., via:

$$\text{ii. } 0 < \int_0^{T_f} F(u(t))dt \leq W_F$$

where $W_F$ is the fuel remaining in the tank at $T_f$. Those skilled in the art will readily recognize that equation (OP) can be in other forms as well and that what is presented above is an exemplary equation for use in the exemplary embodiment of the present invention. For example, those skilled in the art will readily recognize that a variation of equation (OP) is required where multiple power systems, diesel and/or non-diesel, are used to provide multiple thrusters, such as but not limited to those that may be used when operating a marine vessel.

Reference to emissions in the context of the exemplary embodiment of the present invention is actually directed towards cumulative emissions produced in the form of oxides of nitrogen (NOx), carbon oxides ($CO_x$), unburned hydrocarbons (HC), and particulate matter (PM), etc. However, other emissions may include, but not be limited to a maximum value of electromagnetic emission, such as a limit on radio frequency (RF) power output, measured in watts, for respective frequencies emitted by the locomotive. Yet another form of emission is the noise produced by the locomotive, typically measured in decibels (dB). An emission requirement may be variable based on a time of day, a time of year, and/or atmospheric conditions such as weather or pollutant level in the atmosphere. Emission regulations may vary geographically across a railroad system. For example, an operating area such as a city or state may have specified emission objectives, and an adjacent area may have different emission objectives, for example a lower amount of allowed emissions or a higher fee charged for a given level of emissions.

Accordingly, an emission profile for a certain geographic area may be tailored to include maximum emission values for each of the regulated emissions included in the profile to meet a predetermined emission objective required for that area. Typically, for a locomotive, these emission parameters are determined by, but not limited to, the power (Notch) setting, ambient conditions, engine control method, etc. By design, every locomotive must be compliant with EPA emission standards, and thus in an embodiment of the present invention that optimizes emissions this may refer to mission-total emissions, for which there is no current EPA specification. Operation of the locomotive according to the optimized trip plan is at all times compliant with EPA emission standards. Those skilled in the art will readily recognize that because diesel engines are used in other applications, other regulations may also be applicable. For example, $CO_2$ emissions are considered in certain international treaties.

If a key objective during a trip mission is to reduce emissions, the optimal control formulation, equation (OP), would be amended to consider this trip objective. A key flexibility in the optimization setup is that any or all of the trip objectives can vary by geographic region or mission. For example, for a high priority train, minimum time may be the only objective on one route because it is high priority traffic. In another example emission output could vary from state to state along the planned train route.

To solve the resulting optimization problem, in an exemplary embodiment the present invention transcribes a dynamic optimal control problem in the time domain to an equivalent static mathematical programming problem with N decision variables, where the number 'N' depends on the frequency at which throttle and braking adjustments are made and the duration of the trip. For typical problems, this N can be in the thousands. For example, in an exemplary embodiment, suppose a train is traveling a 172-mile (276.8 kilometers) stretch of track in the southwest United States. Utilizing the exemplary embodiment of the present invention, an exemplary 7.6% saving in fuel used may be realized when comparing a trip determined and followed using the exemplary embodiment of the present invention versus an actual driver throttle/speed history where the trip was determined by an operator. The improved savings is realized because the optimization realized by using the exemplary embodiment of the present invention produces a driving strategy with both less drag loss and little or no braking loss compared to the trip plan of the operator.

Figure 2:
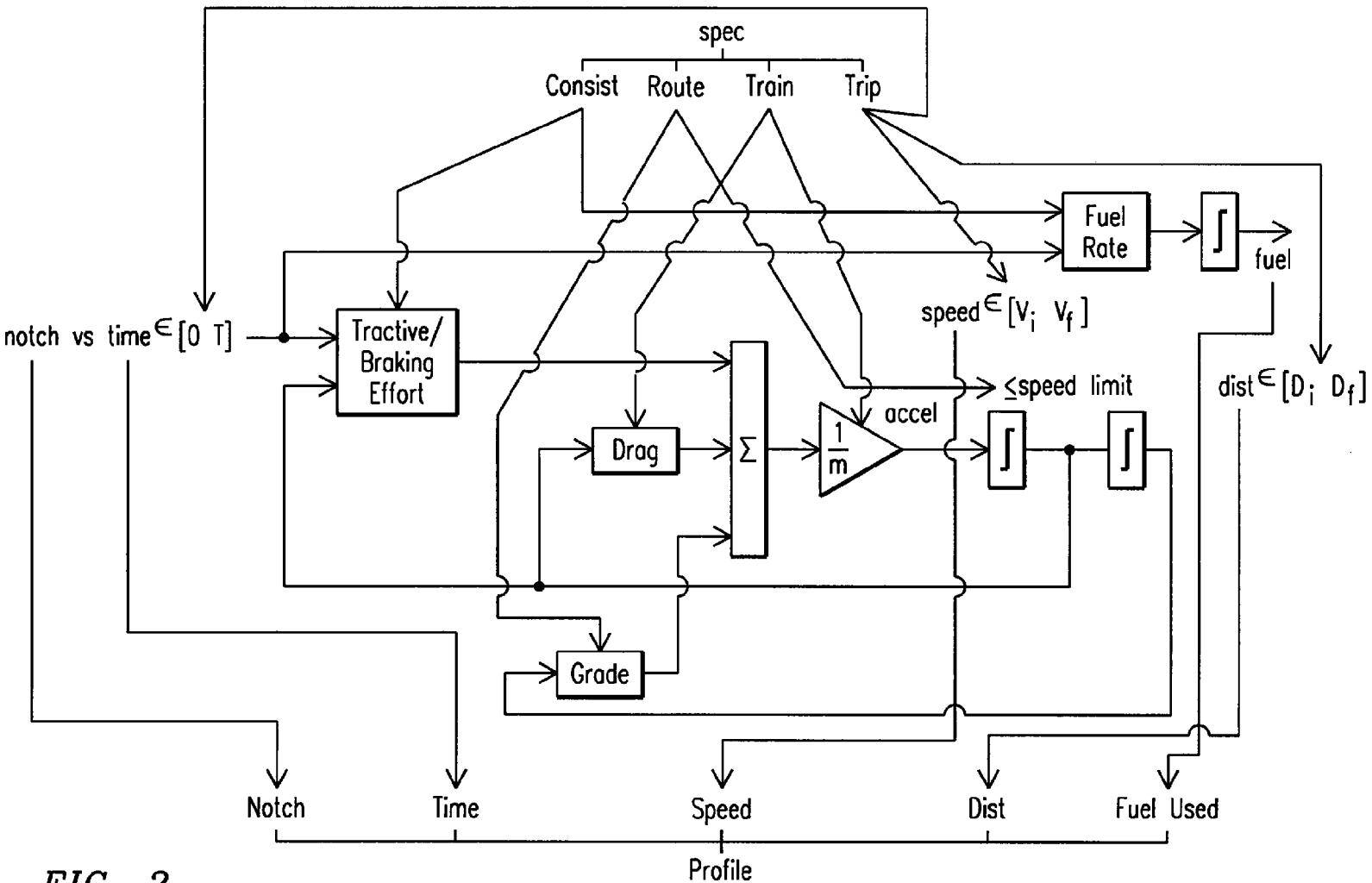
FIG. 2 depicts a simplified a mathematical model of the train that may be employed in connection with the present invention.

To make the optimization described above computationally tractable, a simplified mathematical model of the train may be employed, such as illustrated in FIG. 2 and the equations discussed above. As illustrated, certain set specifications, such as but not limited to information about the consist, route information, train information, and/or trip information, are considered to determine a profile, preferably an optimized profile. Such factors included in the profile include, but are not limited to, speed, distance remaining in the mission, and/or fuel used. As disclosed herein, other factors that may be included in the profile are notch setting and time. One possible refinement to the optimal profile is produced by driving a more detailed model with the optimal power sequence generated, to test if other thermal, electrical, and mechanical constraints are violated. This leads to a modified profile with speed versus distance that is closest to a run that can be achieved without harming locomotive or train equipment, i.e., satisfying additional implied constraints such as thermal and electrical limits on the locomotive and inter-car forces in the train. Those skilled in the art will readily recognize how the equations discussed herein are utilized with FIG. 2.

Referring back to FIG. 1, once the trip is started 12, power commands are generated 14 to put the plan in motion. Depending on the operational set-up of the exemplary embodiment of the present invention, one command is for the locomotive to follow the optimized power command 16 so as to achieve the optimal speed. The exemplary embodiment of the present invention obtains actual speed and power information from the locomotive consist of the train 18. Owing to the inevitable approximations in the models used for the optimization, a closed-loop calculation of corrections to optimized power is obtained to track the desired optimal speed. Such corrections of train operating limits can be made automatically or by the operator, who always has ultimate control of the train.

In some cases, the model used in the optimization may differ significantly from the actual train. This can occur for many reasons, including but not limited to, extra cargo pickups or setouts, locomotives that fail in route, and errors in the initial database 63 or data entry by the operator. For these reasons a monitoring system is in place that uses real-time train data to estimate locomotive and/or train parameters in real time 20. The estimated parameters are then compared to the assumed parameters used when the trip was initially created 22. Based on any differences in the assumed and estimated values, the trip may be re-planned 24, should large enough savings accrue from a new plan.

Other reasons a trip may be re-planned include directives from a remote location, such as dispatch, and/or the operator requesting a change in objectives to be consistent with more global movement planning objectives. Additional global movement planning objectives may include, but are not limited to, other train schedules, allowing exhaust to dissipate from a tunnel, maintenance operations, etc. Another reason may be due to an onboard failure of a component. Strategies for re-planning may be grouped into incremental and major adjustments depending on the severity of the disruption, as discussed in more detail below. In general, a "new" plan must be derived from a solution to the optimization problem equation (OP) described above, but frequently faster approximate solutions can be found, as described herein.

Figure 4:
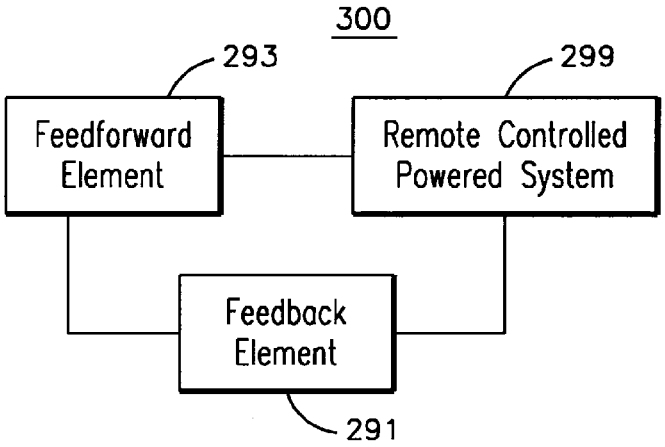
FIG. 4 depicts a diagram illustrating an exemplary embodiment of a closed loop system for remotely controlling a powered system.

In operation, the locomotive 42 will continuously monitor system efficiency and continuously update the trip plan based on the actual efficiency measured, whenever such an update would improve trip performance. Re-planning computations may be carried out entirely within the locomotive(s) or fully or partially moved to a remote location, such as dispatch or wayside processing facilities where wireless technology is used to communicate the plans to the locomotive 42. The exemplary embodiment of the present invention may also generate efficiency trends that can be used to develop locomotive fleet data regarding efficiency transfer functions. The fleet-wide data may be used when determining the initial trip plan, and may be used for network-wide optimization tradeoff when considering locations of a plurality of trains. For example, the travel-time fuel use tradeoff curve as illustrated in FIG. 4 reflects a capability of a train on a particular route at a current time, updated from ensemble averages collected for many similar trains on the same route. Thus, a central dispatch facility collecting curves like FIG. 4 from many locomotives could use that information to better coordinate overall train movements to achieve a system-wide advantage in fuel use or throughput. As disclosed above, those skilled in the art will recognize that various fuel types, such as but not limited to diesel fuel, heavy marine fuels, palm oil, bio-diesel, etc., may be used.

Furthermore, as disclosed above, those skilled in the art will recognize that various energy storage devices may be used. For example, the amount of power withdrawn from a particular source, such as a diesel engine and batteries, could be optimized so that the maximum fuel efficiency/emission, which may be an objective function, is obtained. As further illustration, suppose the total power demand is 2000 horse power (HP), where the batteries can supply 1500 HP and the engine can supply 4400 HP, the optimum point could be when batteries are supplying 1200 HP and engine is supplying 200 HP.

Similarly, the amount of power may also be based on the amount of energy stored and the need for the energy in the future. For example, if there is a long high demand coming for power, the battery could be discharged at a slower rate. For example if 1000 horsepower hour (HPhr) is stored in the battery and the demand is 4400 HP for the next 2 hours, it may be optimum to discharge the battery at 800 HP for the next 1.25 hours and take 3600 HP from the engine for that duration.

Many events in daily operations can lead to a need to generate or modify a currently executing plan, where it desired to keep the same trip objectives, for example when a train is not on schedule for planned meet or pass with another train and it needs to make up time. Using the actual speed, power and location of the locomotive, a comparison is made between a planned arrival time and the currently estimated (predicted) arrival time 25. Based on a difference in the times, as well as the difference in parameters (detected or changed by dispatch or the operator), the plan is adjusted 26. This adjustment may be made automatically according to a railroad company's desire for how such departures from plan should be handled, or alternatives may be manually proposed for the on-board operator and dispatcher to jointly decide the best way to get back on plan. Whenever a plan is updated but where the original objectives (such as but not limited to arrival time) remain the same, additional changes may be factored in concurrently, e.g., new future speed limit changes, which could affect the feasibility of ever recovering the original plan. In such instances, if the original trip plan cannot be maintained, or in other words the train is unable to meet the original trip plan objectives, as discussed herein other trip plan(s) may be presented to the operator and/or remote facility, or dispatch.

A re-plan may also be made when it is desired to change the original objectives. Such re-planning can be done at either fixed preplanned times, manually at the discretion of the operator or dispatcher, or autonomously when predefined limits, such as train operating limits, are exceeded. For example, if the current plan execution is running late by more than a specified threshold, such as thirty minutes, the exemplary embodiment of the present invention can re-plan the trip to accommodate the delay at the expense of increased fuel use, as described above, or to alert the operator and dispatcher how much of the time can be made up at all (i.e., what minimum time to go or the maximum fuel that can be saved within a time constraint). Other triggers for re-plan can also be envisioned based on fuel consumed or the health of the power consist, including but not limited time of arrival, loss of horsepower due to equipment failure and/or equipment temporary malfunction (such as operating too hot or too cold), and/or detection of gross setup errors, such as in the assumed train load. That is, if the change reflects impairment in the locomotive performance for the current trip, these may be factored into the models and/or equations used in the optimization.

Changes in plan objectives can also arise from a need to coordinate events where the plan for one train compromises the ability of another train to meet objectives and arbitration at a different level, e.g. the dispatch office is required. For example, the coordination of meets and passes may be further optimized through train-to-train communications. Thus, as an example, if a train knows that it is behind schedule in reaching a location for a meet and/or pass, communications from the other train can notify the late train (and/or dispatch). The operator can then enter information pertaining to being late into the exemplary embodiment of the present invention, wherein the exemplary embodiment will recalculate the train's trip plan. The exemplary embodiment of the present invention can also be used at a high level, or network level, to allow a dispatch to determine which train should slow down or speed up should a scheduled meet and/or pass time constraint may not be met. As discussed herein, this is accomplished by trains transmitting data to the dispatch to prioritize how each train should change its planning objective. A choice could based on either schedule or fuel saving benefits, depending on the situation.

Figure 5:
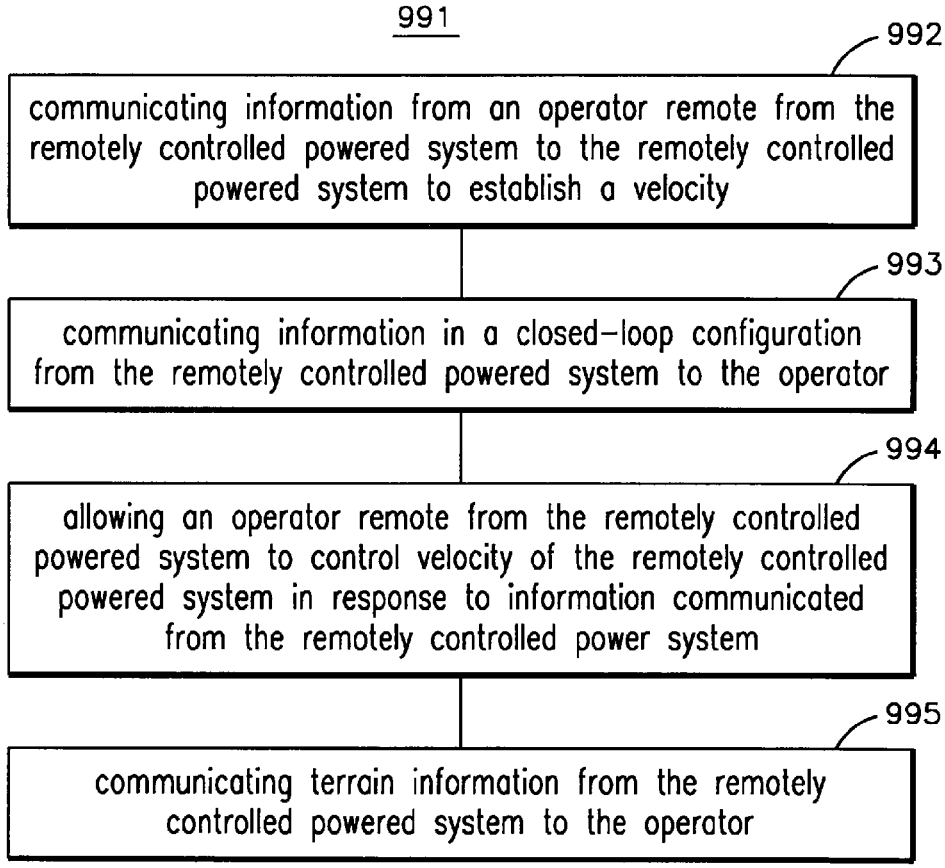
FIG. 5 depicts a flowchart illustrating an exemplary embodiment for operating a remotely controlled powered system.

For any of the manually or automatically initiated re-plans, exemplary embodiments of the present invention may present more than one trip plan to the operator. In an exemplary embodiment the present invention will present different profiles to the operator, allowing the operator to select the arrival time and understand the corresponding fuel and/or emission impact. Such information can also be provided to the dispatch for similar consideration, either as a simple list of alternatives or as a plurality of tradeoff curves such as illustrated in FIG. 5.

The exemplary embodiment of the present invention has the ability to learn and adapt to key changes in the train and power consist which can be incorporated either in the current plan and/or in future plans. For example, one of the triggers discussed above is loss of horsepower. When building up horsepower over time, either after a loss of horsepower or when beginning a trip, transition logic is utilized to determine when desired horsepower is achieved. This information can be saved in the locomotive database 61 for use in optimizing either future trips or the current trip should loss of horsepower occur again.

Likewise, in a similar fashion where multiple thrusters are available, each may need to be independently controlled. For example, a marine vessel may have many force producing elements, or thrusters, such as but not limited to propellers. Each propeller may need to be independently controlled to produce the optimum output. Therefore, utilizing transition logic, the trip optimizer may determine which propeller to operate based on what has been learned previously and by adapting to key changes in the marine vessel's operation.

Figure 3:
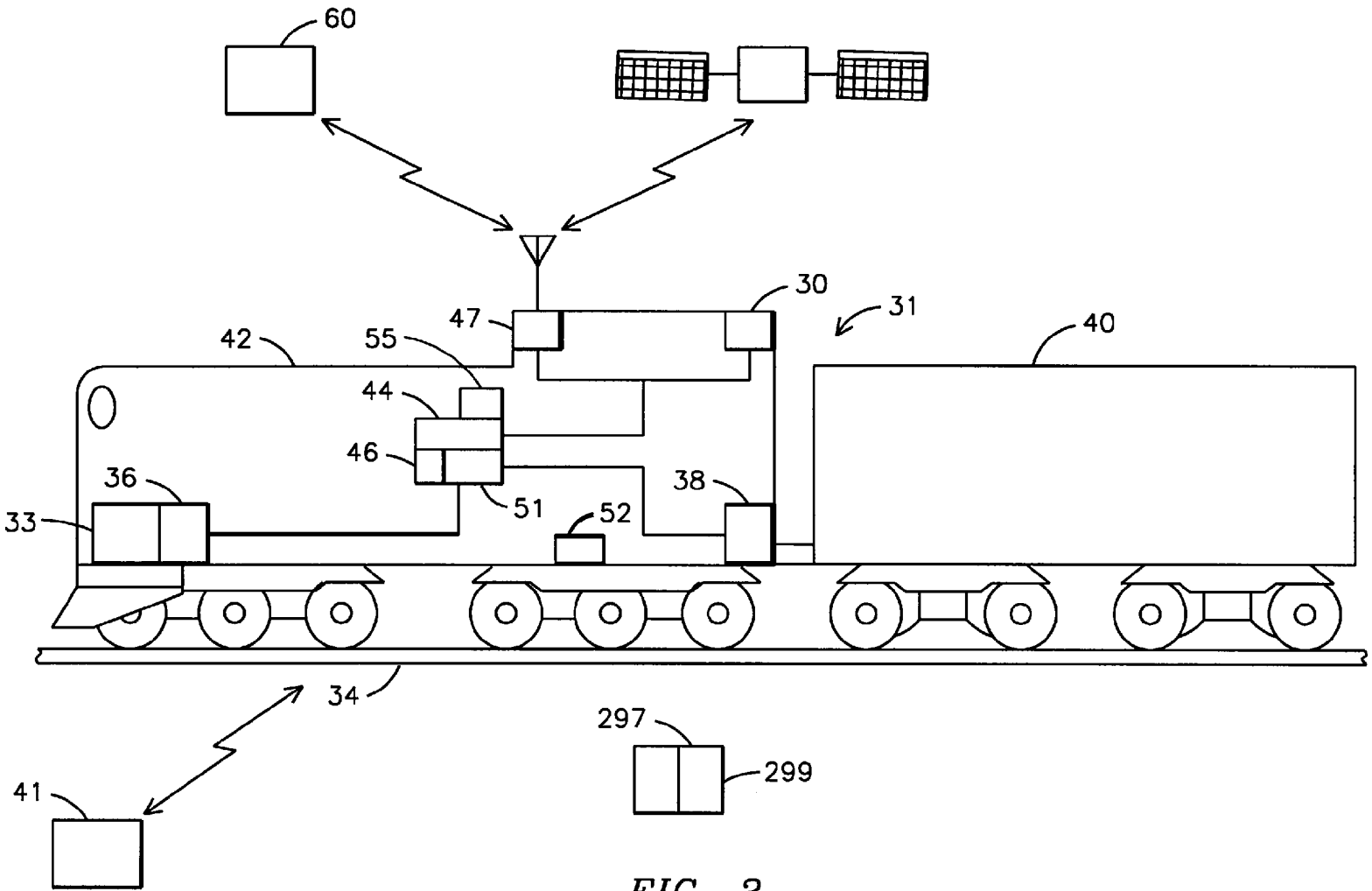
FIG. 3 depicts an exemplary embodiment of elements for trip optimization.

FIG. 3 depicts various elements that may be part of a trip optimizer system, according to an exemplary embodiment of the invention. A locator element 30 to determine a location of the train 31 is provided. The locator element 30 can be a GPS sensor, or a system of sensors, that determines a location of the train 31. Examples of such other systems may include, but are not limited to, wayside devices, such as radio frequency automatic equipment identification (RF AEI) tags, dispatch, and/or video determination. Another system may include the tachometer(s) aboard a locomotive and distance calculations from a reference point. As discussed previously, a wireless communication system 47 may also be provided to allow for communications between trains and/or with a remote location, such as dispatch. Information about travel locations may also be transferred from other trains.

A track characterization element 33 to provide information about a track, principally grade and elevation and curvature information, is also provided. The track characterization element 33 may include an on-board track integrity database 36. Sensors 38 are used to measure a tractive effort 40 being hauled by the locomotive consist 42, throttle setting of the locomotive consist 42, locomotive consist 42 configuration information, speed of the locomotive consist 42, individual locomotive configuration, individual locomotive capability, etc. In an exemplary embodiment the locomotive consist 42 configuration information may be loaded without the use of a sensor 38, but is input in another manner as discussed above. Furthermore, the health of the locomotives in the consist may also be considered. For example, if one locomotive in the consist is unable to operate above power notch level 5, this information is used when optimizing the trip plan.

Information from the locator element may also be used to determine an appropriate arrival time of the train 31. For example, if there is a train 31 moving along a track 34 towards a destination and no train is following behind it, and the train has no fixed arrival deadline to adhere to, the locator element, including but not limited to RF AEI tags, dispatch, and/or video determination, may be used to gage the exact location of the train 31. Furthermore, inputs from these signaling systems may be used to adjust the train speed. Using the on-board track database, discussed below, and the locator element, such as GPS, the exemplary embodiment of the present invention can adjust the operator interface to reflect the signaling system state at the given locomotive location. In a situation where signal states would indicate restrictive speeds ahead, the planner may elect to slow the train to conserve fuel consumption.

Information from the locator element 30 may also be used to change planning objectives as a function of distance to destination. For example, owing to inevitable uncertainties about congestion along the route, "faster" time objectives on the early part of a route may be employed as a hedge against delays that statistically occur later. If it happens on a particular trip that delays do not occur, the objectives on a latter part of the journey can be modified to exploit the built-in slack time that was banked earlier, and thereby recover some fuel efficiency. A similar strategy could be invoked with respect to emissions restrictive objectives, e.g., approaching an urban area.

As an example of the hedging strategy, if a trip is planned from New York to Chicago, the system may have an option to operate the train slower at either the beginning of the trip or at the middle of the trip or at the end of the trip. The exemplary embodiment of the present invention would optimize the trip plan to allow for slower operation at the end of the trip since unknown constraints, such as but not limited to weather conditions, track maintenance, etc., may develop and become known during the trip. As another consideration, if traditionally congested areas are known, the plan is developed with an option to have more flexibility around these traditionally congested regions. Therefore, the exemplary embodiment of the present invention may also consider weighting/penalty as a function of time/distance into the future and/or based on known/past experience. Those skilled in the art will readily recognize that such planning and re-planning to take into consideration weather conditions, track conditions, other trains on the track, etc., may be taken into consideration at any time during the trip wherein the trip plan is adjust accordingly.

FIG. 3 further discloses other elements that may be part of the exemplary embodiment of the trip optimizer. A processor 44 is provided that is operable to receive information from the locator element 30, track characterizing element 33, and sensors 38. An algorithm 46 operates within the processor 44. The algorithm 46 is used to compute an optimized trip plan based on parameters involving the locomotive 42, train 31, track 34, and objectives of the mission as described above. Therefore such information as trip manifest data is also provided and may be retained in a database, such as but not limited to the track database 36 storage unit. In an exemplary embodiment, the trip plan is established based on models for train behavior as the train 31 moves along the track 34 as a solution of non-linear differential equations derived from physics with simplifying assumptions that are provided in the algorithm. The algorithm 46 has access to the information from the locator element 30, track characterizing element 33, and/or sensors 38 to create a trip plan minimizing fuel consumption of a locomotive consist 42, minimizing emissions of a locomotive consist 42, establishing a desired trip time, and/or ensuring proper crew operating time aboard the locomotive consist 42. In an exemplary embodiment, a driver or operator, and/or controller element, 51 is also provided. As discussed herein the controller element 51 is used for controlling the train as it follows the trip plan. In an exemplary embodiment discussed further herein, the controller element 51 makes train operating decisions autonomously. In another exemplary embodiment the operator may be involved with directing the train to follow the trip plan.

A feature of the exemplary embodiment of the present invention is the ability to initially create and quickly modify "on the fly" any plan that is being executed. This includes creating the initial plan when a long distance is involved, owing to the complexity of the plan optimization algorithm. When a total length of a trip profile exceeds a given distance, an algorithm 46 may be used to segment the mission, wherein the mission may be divided by waypoints. Though only a single algorithm 46 is discussed, those skilled in the art will readily recognize that more than one algorithm may be used (or that the same algorithm may be executed a plurality of times), wherein the algorithms may be connected together. The waypoint may include natural locations where the train 31 stops, such as, but not limited to, sidings where a meet with opposing traffic (or pass with a train behind the current train) is scheduled to occur on a single-track rail, or at yard sidings or industry where cars are to be picked up and set out, and locations of planned work. At such waypoints, the train 31 may be required to be at the location at a scheduled time and be stopped or moving with speed in a specified range. The time duration from arrival to departure at waypoints is called "dwell time."

With respect to a remote controlled powered system, such as but not limited to a remotely controlled locomotive (RCL), exemplary elements disclosed in FIG. 3 may further be used to provide for better speed regulation of the RCL. Specifically, terrain information, such as but not limited to information contained in the track database 36 may be used to optimize speed regulation. As disclosed, the information in the track database 36 may be obtain manually and/or automatically (e.g., such as but not limited to an AEI tag reader). Speed regulation is performed by commanding a speed regulator 55 aboard the RCL. An operator control unit 299, is also disclosed.

FIG. 4 discloses a block diagram illustrating an exemplary embodiment of feedforward gains and feedback gains that are used to optimize performance of the speed regulator. A feedforward element, or feedforward gains element, 293 and a feedback element 291, or feedback gains element, may be used. As illustrated a closed-loop process 300 is disclosed. Information, such as either a motoring command or a braking command is inputted to the RCL, through the operator control unit 299. Terrain information, as well as other operational information is provided from the locomotive 31 back to the operator control unit. Based on the information being relayed from the locomotive, or feedback gains, the operator is able to use the operator control unit 299 to adjust, or regulate speed, of the RCL.

The operator control unit 299 may further have a display 297 area to display information, or feedback information, such as is disclosed below with respect to FIGS. 8-19B. Therefore those skilled in the art will readily recognize that the feedback information may be either visual, audible, alphanumeric, text based, and/or a combination of any of these exemplary examples.

FIG. 5 discloses a flowchart illustrating an exemplary embodiment for operating a remotely controlled powered system. As disclosed in the flowchart 991, information is communicated from an operator who is remote from the remotely controlled powered system to the remotely controlled powered system to establish velocity, at 992. Information is communicated in a closed-loop configuration from the remotely controlled powered system to the operator, at 993. The operator may control velocity in response to the information received, at 994. The information communicated to the operator may include terrain information, at 995. The flowchart 991 disclosed in FIG. 5 may also be implemented with a computer software code that operates within a processor and is storable on a computer readable media.

Figure 6:
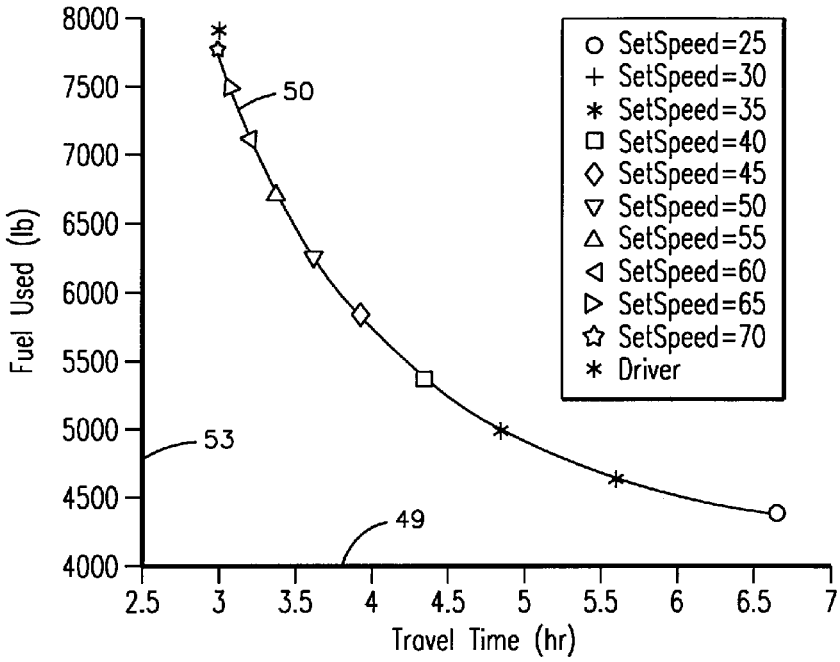
FIG. 6 depicts an exemplary embodiment of a fuel-use/travel time curve.

In an exemplary embodiment, the present invention is able to break down a longer trip into smaller segments in a special systematic way. Each segment can be somewhat arbitrary in length, but is typically picked at a natural location such as a stop or significant speed restriction, or at key mileposts that define junctions with other routes. Given a partition, or segment, selected in this way, a driving profile is created for each segment of track as a function of travel time taken as an independent variable, such as shown in FIG. 6. The fuel used/travel-time tradeoff associated with each segment can be computed prior to the train 31 reaching that segment of track. A total trip plan can be created from the driving profiles created for each segment. The exemplary embodiment of the invention distributes travel time amongst all the segments of the trip in an optimal way so that the total trip time required is satisfied and total fuel consumed over all the segments is as small as possible. An exemplary 3-segment trip is disclosed in FIG. 7 and discussed below. Those skilled in the art will recognize however, through segments are discussed, the trip plan may comprise a single segment representing the complete trip.

FIG. 6 depicts an exemplary embodiment of a fuel-use/travel time curve 50. As mentioned previously, such a curve 50 is created when calculating an optimal trip profile for various travel times for each segment. That is, for a given travel time 49, fuel used 53 is the result of a detailed driving profile computed as described above. Once travel times for each segment are allocated, a power/speed plan is determined for each segment from the previously computed solutions. If there are any waypoint constraints on speed between the segments, such as, but not limited to, a change in a speed limit, they are matched up during creation of the optimal trip profile. If speed restrictions change in only a single segment, the fuel use/travel-time curve 50 has to be re-computed for only the segment changed. This reduces time for having to recalculate more parts, or segments, of the trip. If the locomotive consist or train changes significantly along the route, e.g., from loss of a locomotive or pickup or set-out of cars, then driving profiles for all subsequent segments must be recomputed, thereby creating new instances of the curve 50. These new curves 50 would then be used along with new schedule objectives to plan the remaining trip.

Once a trip plan is created as discussed above, a trajectory of speed and power versus distance is used to reach a destination with minimum fuel use and/or emissions at the required trip time. There are several ways in which to execute the trip plan. As provided below in more detail, in an exemplary embodiment, when in an operator "coaching" mode, information is displayed to the operator for the operator to follow to achieve the required power and speed determined according to the optimal trip plan. In this mode, the operating information includes suggested operating conditions that the operator should use. In another exemplary embodiment, acceleration and maintaining a constant speed are autonomously performed. However, when the train 31 must be slowed, the operator is responsible for applying a braking system 52. In another exemplary embodiment of the present invention, commands for powering and braking are provided as required to follow the desired speed-distance path.

Feedback control strategies are used to provide corrections to the power control sequence in the profile to correct for events such as, but not limited to, train load variations caused by fluctuating head winds and/or tail winds. Another such error may be caused by an error in train parameters, such as, but not limited to, train mass and/or drag, when compared to assumptions in the optimized trip plan. A third type of error may occur with information contained in the track database 36. Another possible error may involve un-modeled performance differences due to the locomotive engine, traction motor thermal deration and/or other factors. Feedback control strategies compare the actual speed as a function of position to the speed in the desired optimal profile. Based on this difference, a correction to the optimal power profile is added to drive the actual velocity toward the optimal profile. To ensure stable regulation, a compensation algorithm may be provided which filters the feedback speeds into power corrections so that closed-performance stability is ensured. Compensation may include standard dynamic compensation as used by those skilled in the art of control system design to meet performance objectives.

Exemplary embodiments of the present invention allow the simplest and therefore fastest means to accommodate changes in trip objectives, which is the rule, rather than the exception in railroad operations. In an exemplary embodiment, to determine the fuel-optimal trip from point A to point B where there are stops along the way, and for updating the trip for the remainder of the trip once the trip has begun, a sub-optimal decomposition method is usable for finding an optimal trip profile. Using modeling methods, the computation method can find the trip plan with specified travel time and initial and final speeds, so as to satisfy all the speed limits and locomotive capability constraints when there are stops. Though the following discussion is directed towards optimizing fuel use, it can also be applied to optimize other factors, such as, but not limited to, emissions, schedule, crew comfort, and load impact. The method may be used at the outset in developing a trip plan, and more importantly to adapting to changes in objectives after initiating a trip.

Figure 7:
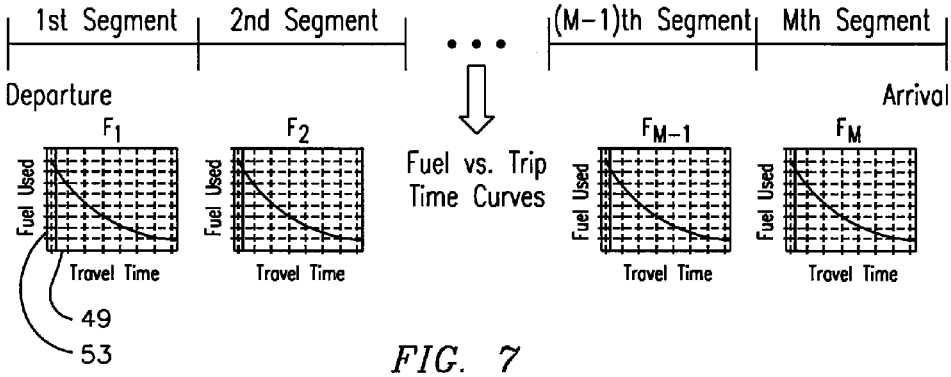
FIG. 7 depicts an exemplary embodiment of segmentation decomposition for trip planning.
Figure 8:
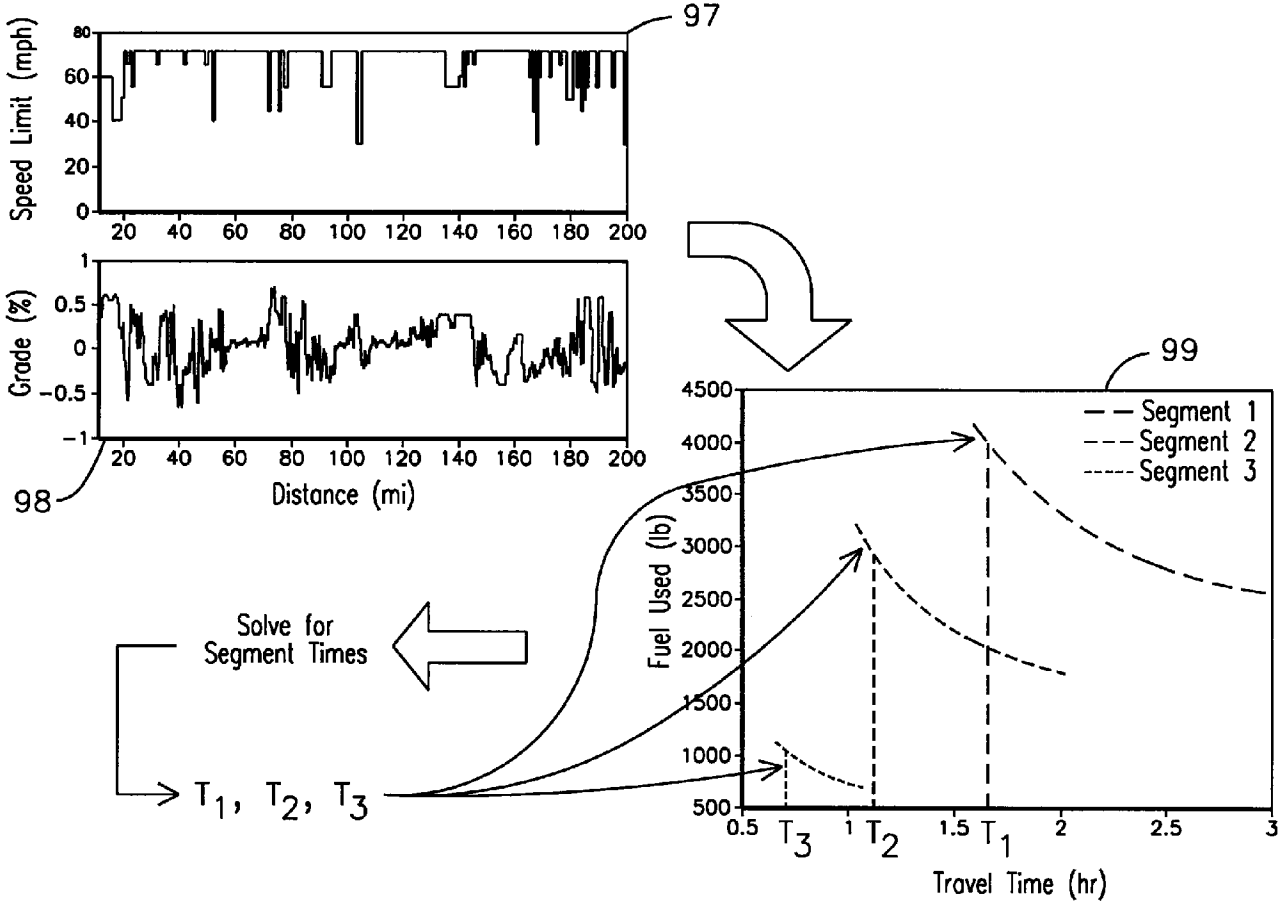
FIG. 8 depicts another exemplary embodiment of a segmentation decomposition for trip planning.

As discussed herein, exemplary embodiments of the present invention may employ a setup as illustrated in the exemplary flow chart depicted in FIG. 7, and as an exemplary segment example depicted in detail in FIG. 8. As illustrated, the trip may be broken into two or more segments, T1, T2, and T3. (As noted above, it is possible to consider the trip as a single segment.) As discussed herein, the segment boundaries may not result in equal segments. Instead, the segments may use natural or mission specific boundaries. Optimal trip plans are pre-computed for each segment. If fuel use versus trip time is the trip object to be met, fuel versus trip time curves are built for each segment. As discussed herein, the curves may be based on other factors, wherein the factors are objectives to be met with a trip plan. When trip time is the parameter being determined, trip time for each segment is computed while satisfying the overall trip time constraints. FIG. 8 illustrates speed limits 97 for an exemplary segment, 200-mile (321.9 kilometers) trip. Further illustrated are grade changes 98 over the 200-mile (321.9 kilometers) trip. A combined chart 99 illustrating curves for each segment of the trip of fuel used over the travel time is also shown.

Using the optimal control setup described previously, the present computation method can find the trip plan with specified travel time and initial and final speeds, so as to satisfy all the speed limits and locomotive capability constraints when there are stops. Though the following detailed discussion is directed towards optimizing fuel use, it can also be applied to optimize other factors as discussed herein, such as, but not limited to, emissions. A key flexibility is to accommodate desired dwell time at stops and to consider constraints on earliest arrival and departure at a location as may be required, for example, in single-track operations where the time to be in or get by a siding is critical.

Exemplary embodiments of the present invention find a fuel-optimal trip from distance $D_0$ to $D_M$, traveled in time T, with M−1 intermediate stops at $D_1, \ldots, D_{M-1}$, and with the arrival and departure times at these stops constrained by:

$$t_{min}(i) \leqq t_{arr}(D_i) \leqq t_{max}(i) - \Delta t_i$$

$$t_{arr}(D_i) + \Delta t_i \leqq t_{dep}(D_i) \leqq t_{max}(i) \quad i = 1, \ldots, M-1$$

where $t_{arr}(D_i)$ $t_{dep}(D_i)$, and $\Delta t_i$ are the arrival, departure, and minimum stop time at the $i^{th}$ stop, respectively. Assuming that fuel-optimality implies minimizing stop time, therefore $t_{dep}(D_i) = t_{arr}(D_i) + \Delta t_i$ which eliminates the second inequality above. Suppose for each i=1, . . . , M, the fuel-optimal trip from $D_{i-1}$ to $D_i$ for travel time t, $T_{min}(i) \leqq t \leqq T_{max}(i)$, is known. Let $F_i(t)$ be the fuel-use corresponding to this trip. If the travel time from $D_{j-1}$ to $D_j$ is denoted $T_j$, then the arrival time at $D_i$ is given by:

$$\text{i. } t_{arr}(D_i) = \sum_{j=1}^{i} (T_j + \Delta t_{j-1})$$

where $\Delta t_0$ is defined to be zero. The fuel-optimal trip from $D_0$ to $D_M$ for travel time T is then obtained by finding $T_i$, i=1, . . . , M, which minimize:

$$\text{ii. } \sum_{i=1}^{M} F_i(T_i) T_{min}(i) \leq T_i \leq T_{max}(i)$$

subject to:

$$\text{iii. } t_{min}(i) \leq \sum_{j=1}^{i} (T_j + \Delta t_{j-1}) \leq t_{max}(i) - \Delta t_i \quad i = 1, \ldots, M-1$$

$$\text{iv. } \sum_{j=1}^{M} (T_j + \Delta t_{j-1}) = T$$

Once a trip is underway, the issue is re-determining the fuel-optimal solution for the remainder of a trip (originally from $D_0$ to $D_M$ in time T) as the trip is traveled, but where disturbances preclude following the fuel-optimal solution. Let the current distance and speed be x and v, respectively, where $D_{i-1} < x \leqq D_i$. Also, let the current time since the beginning of the trip be $t_{act}$. Then the fuel-optimal solution for the remainder of the trip from x to $D_M$, which retains the original arrival time at $D_M$, is obtained by finding $\tilde{T}_i$, $T_j$, j=i+1, . . . M, which minimize:

$$\text{i. } \tilde{F}_i(\tilde{T}_i, x, v) + \sum_{j=i+1}^{M} F_j(T_j)$$

subject to:

$$\text{ii. } t_{min}(i) \leq t_{act} + \tilde{T}_i \leq t_{max}(i) - \Delta t_i$$

$$\text{iii. } t_{min}(k) \leq t_{act} + \tilde{T}_i + \sum_{j=i+1}^{k} (T_j + \Delta t_{j-1}) \leq t_{max}(k) - \Delta t_k$$

$$k = i+1, \ldots, M-1$$

$$\text{iv. } t_{act} + \tilde{T}_i + \sum_{j=i+1}^{M} (T_j + \Delta t_{j-1}) = T$$

Here, $\tilde{F}_i(t, x, v)$ is the fuel-used of the optimal trip from x to $D_i$, traveled in time t, with initial speed at x of v.

As discussed above, an exemplary way to enable more efficient re-planning is to construct the optimal solution for a stop-to-stop trip from partitioned segments. For the trip from $D_{i-1}$ to $D_i$, with travel time $T_i$, choose a set of intermediate points $D_{ij}$, j=1, . . . , $N_i$−1. Let $D_{i0} = D_{i-1}$, and $D_{iN_i} = D_i$. Then express the fuel-use for the optimal trip from $D_{i-1}$ to $D_i$ as:

$$\text{i. } F_i(t) = \sum_{j=1}^{N_i} f_{ij}(t_{ij} - t_{i,j-1}, v_{i,j-1}, v_{ij})$$

where $f_{ij}(t, v_{i,j-1}, v_{ij})$ is the fuel-use for the optimal trip from $D_{i,j-1}$ to $D_{ij}$, traveled in time t, with initial and final speeds of $v_{i,j-1}$ and $v_{ij}$. Furthermore, $t_{ij}$ is the time in the optimal trip corresponding to distance $D_{ij}$. By definition, $t_{iN_i}-t_{i0}=T_i$. Since the train is stopped at $D_{i0}$ and $D_{iN_i}$, $v_{i0}=v_{iN_i}=0$.

The above expression enables the function $F_i(t)$ to be alternatively determined by first determining the functions $f_{ij}(\cdot)$, $1 \leqq j \leqq N_i$, then finding $\tau_{ij}$, $1 \leqq j \leqq N_i$ and $v_{ij}$, $1 \leqq j < N_i$, which minimize:

$$\text{i. } F_i(t) = \sum_{j=1}^{N_i} f_{ij}(\tau_{ij}, v_{i,j-1}, v_{ij})$$

subject to:

$$\text{ii. } \sum_{j=1}^{N_i} \tau_{ij} = T_i$$

$$\text{iii. } v_{min}(i, j) \leq v_{ij} \leq v_{max}(i, j) \quad j = 1, \ldots, N_i - 1$$

$$\text{iv. } v_{i0} = v_{iN_i} = 0$$

By choosing $D_{ij}$(e.g., at speed restrictions or meeting points), $v_{max}(i, j)-v_{min}(i, j)$ can be minimized, thus minimizing the domain over which $f_{ij}(\,)$ needs to be known.

Based on the partitioning above, a simpler suboptimal re-planning approach than that described above is to restrict re-planning to times when the train is at distance points $D_{ij}$, $1 \leqq i \leqq M$, $1 \leqq j \leqq N_i$. At point $D_{ij}$, the new optimal trip from $D_{ij}$ to $D_M$ can be determined by finding $\tau_{ik}$, $j<k \leqq N_i$, $v_{ik}<k<N_i$, and $\tau_{mn}$, $i<m \leqq M$, $1 \leqq n \leqq N_m$, $v_{mn}$, $i<m \leqq M$, $1 \leqq n < N_m$, which minimize:

$$\text{i. } \sum_{k=j+1}^{N_i} f_{ik}(\tau_{ik}, v_{i,k-1}, v_{ik}) + \sum_{m=i+1}^{M} \sum_{n=1}^{N_m} f_{mn}(\tau_{mn}, v_{m,n-1}, v_{mn})$$

subject to:

$$\text{ii. } t_{min}(i) \leq t_{act} + \sum_{k=j+1}^{N_i} \tau_{ik} \leq t_{max}(i) - \Delta t_i$$

$$\text{iii. } t_{min}(n) \leq t_{act} + \sum_{k=j+1}^{N_i} \tau_{ik} + \sum_{m=i+1}^{n} (T_m + \Delta t_{m-1}) \leq t_{max}(n) - \Delta t_n$$

$$n = i+1, \ldots, M-1$$

$$\text{iv. } t_{act} = \sum_{k=j+1}^{N_i} \tau_{ik} + \sum_{m=i+1}^{M} (T_m + \Delta t_{m-1}) = T$$

where:

$$\text{v. } T_m = \sum_{n=1}^{N_m} \tau_{mn}$$

A further simplification is obtained by waiting on the re-computation of $T_m$, $i<m \leqq M$, until distance point $D_i$ is reached. In this way, at points $D_{ij}$ between $D_{i-1}$, and $D_i$, the minimization above needs only be performed over $\tau_{ik}$, $j<k \leqq N_i$, $v_{ik}$, $j<k<N_i$. $T_i$ is increased as needed to accommodate any longer actual travel time from $D_{i-1}$, to $D_{ij}$ than planned. This increase is later compensated, if possible, by the re-computation of $T_m$, $i<m \leqq M$, at distance point $D_i$.

With respect to the closed-loop configuration disclosed above, the total input energy required to move a train 31 from point A to point B consists of the sum of four components, specifically, difference in kinetic energy between points A and B; difference in potential energy between points A and B; energy loss due to friction and other drag losses; and energy dissipated by the application of brakes. Assuming the start and end speeds to be equal (e.g., stationary), the first component is zero. Furthermore, the second component is independent of driving strategy. Thus, it suffices to minimize the sum of the last two components.

Following a constant speed profile minimizes drag loss. Following a constant speed profile also minimizes total energy input when braking is not needed to maintain constant speed. However, if braking is required to maintain constant speed, applying braking just to maintain constant speed will most likely increase total required energy because of the need to replenish the energy dissipated by the brakes. A possibility exists that some braking may actually reduce total energy usage if the additional brake loss is more than offset by the resultant decrease in drag loss caused by braking, by reducing speed variation.

After completing a re-plan from the collection of events described above, the new optimal notch/speed plan can be followed using the closed loop control described herein. However, in some situations there may not be enough time to carry out the segment decomposed planning described above, and particularly when there are critical speed restrictions that must be respected, an alternative is needed. Exemplary embodiments of the present invention accomplish this with an algorithm referred to as "smart cruise control." The smart cruise control algorithm is an efficient way to generate, on the fly, an energy-efficient (hence fuel-efficient) sub-optimal prescription for driving the train 31 over a known terrain. This algorithm assumes knowledge of the position of the train 31 along the track 34 at all times, as well as knowledge of the grade and curvature of the track versus position. The method relies on a point-mass model for the motion of the train 31, whose parameters may be adaptively estimated from online measurements of train motion as described earlier.

The smart cruise control algorithm has three principal components, specifically, a modified speed limit profile that serves as an energy-efficient (and/or emissions efficient or any other objective function) guide around speed limit reductions; an ideal throttle or dynamic brake setting profile that attempts to balance between minimizing speed variation and braking; and a mechanism for combining the latter two components to produce a notch command, employing a speed feedback loop to compensate for mismatches of modeled parameters when compared to reality parameters. Smart cruise control can accommodate strategies in exemplary embodiments of the present invention that do no active braking (e.g., the driver is signaled and assumed to provide the requisite braking) or a variant that does active braking.

With respect to the cruise control algorithm that does not control dynamic braking, the three exemplary components are a modified speed limit profile that serves as an energy-efficient guide around speed limit reductions, a notification signal directed to notify the operator when braking should be applied, an ideal throttle profile that attempts to balance between minimizing speed variations and notifying the operator to apply braking, a mechanism employing a feedback loop to compensate for mismatches of model parameters to reality parameters.

Also included in exemplary embodiments of the present invention is an approach to identify key parameter values of the train 31. For example, with respect to estimating train mass, a Kalman filter and a recursive least-squares approach may be utilized to detect errors that may develop over time.

Figure 9:
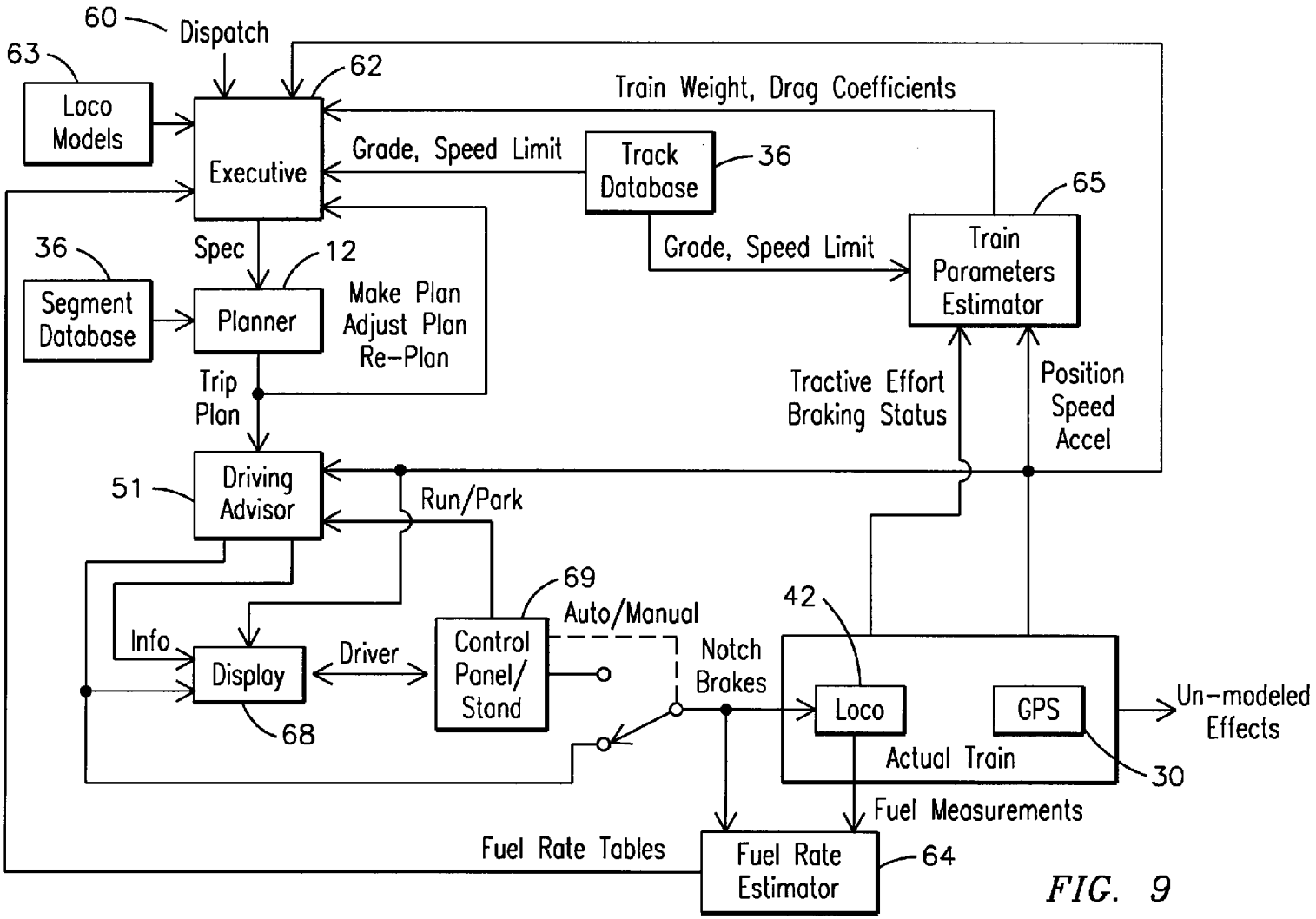
FIG. 9 depicts another exemplary flow chart trip optimization.

FIG. 9 depicts an exemplary flow chart of the present invention. As discussed previously, a remote facility, such as a dispatch 60, can provide information. As illustrated, such information is provided to an executive control element 62. Also supplied to the executive control element 62 is information from a locomotive modeling database 63, information from a track database 36 such as, but not limited to, track grade information and speed limit information, estimated train parameters such as, but not limited to, train weight and drag coefficients, and fuel rate tables from a fuel rate estimator 64. The executive control element 62 supplies information to the planner 12, which is disclosed in more detail in FIG. 1. Once a trip plan has been calculated, the plan is supplied to a driving advisor, driver, or controller element 51. The trip plan is also supplied to the executive control element 62 so that it can compare the trip when other new data is provided.

As discussed above, the driving advisor 51 can automatically set a notch power, either a pre-established notch setting or an optimum continuous notch power. In addition to supplying a speed command to the locomotive 42, a display 68 is provided so that the operator can view what the planner has recommended. The operator also has access to a control panel 69. Through the control panel 69 the operator can decide whether to apply the notch power recommended. Towards this end, the operator may limit a targeted or recommended power. That is, at any time the operator always has final authority over what power setting the locomotive consist will operate at. This includes deciding whether to apply braking if the trip plan recommends slowing the train 31. For example, if operating in dark territory, or where information from wayside equipment cannot electronically transmit information to a train and instead the operator views visual signals from the wayside equipment, the operator inputs commands based on information contained in the track database and visual signals from the wayside equipment. Based on how the train 31 is functioning, information regarding fuel measurement is supplied to the fuel rate estimator 64. Since direct measurement of fuel flows is not typically available in a locomotive consist, all information on fuel consumed so far within a trip and projections into the future following optimal plans is carried out using calibrated physics models such as those used in developing the optimal plans. For example, such predictions may include, but are not limited to, the use of measured gross horse-power and known fuel characteristics and emissions characteristics to derive the cumulative fuel used and emissions generated.

The train 31 also has a locator device 30 such as a GPS sensor, as discussed above. Information is supplied to the train parameters estimator 65. Such information may include, but is not limited to, GPS sensor data, tractive/braking effort data, braking status data, speed, and any changes in speed data. With information regarding grade and speed limit information, train weight and drag coefficients information is supplied to the executive control element 62.

Exemplary embodiments of the present invention may also allow for the use of continuously variable power throughout the optimization planning and closed loop control implementation. In a conventional locomotive, power is typically quantized to eight discrete levels. Modern locomotives can realize continuous variation in horsepower which may be incorporated into the previously described optimization methods. With continuous power, the locomotive 42 can further optimize operating conditions, e.g., by minimizing auxiliary loads and power transmission losses, and fine tuning engine horsepower regions of optimum efficiency, or to points of increased emissions margins. Example include, but are not limited to, minimizing cooling system losses, adjusting alternator voltages, adjusting engine speeds, and reducing number of powered axles. Further, the locomotive 42 may use the on-board track database 36 and the forecasted performance requirements to minimize auxiliary loads and power transmission losses to provide optimum efficiency for the target fuel consumption/emissions. Examples include, but are not limited to, reducing a number of powered axles on flat terrain and pre-cooling the locomotive engine prior to entering a tunnel.

Exemplary embodiments of the present invention may also use the on-board track database 36 and the forecasted performance to adjust the locomotive performance, such as to insure that the train has sufficient speed as it approaches a hill and/or tunnel. For example, this could be expressed as a speed constraint at a particular location that becomes part of the optimal plan generation created solving the equation (OP). Additionally, exemplary embodiments of the present invention may incorporate train-handling rules, such as, but not limited to, tractive effort ramp rates and maximum braking effort ramp rates. These may be incorporated directly into the formulation for optimum trip profile or alternatively incorporated into the closed loop regulator used to control power application to achieve the target speed.

In one embodiment, the present invention is only installed on a lead locomotive of the train consist. Even though exemplary embodiments of the present invention are not dependant on data or interactions with other locomotives, it may be integrated with a consist manager, as disclosed in U.S. Pat. Nos. 6,691,957 and 7,021,588 (owned by the Assignee and both incorporated by reference), functionality and/or a consist optimizer functionality to improve efficiency.

Interaction with multiple trains is not precluded, as illustrated by the example of dispatch arbitrating two "independently optimized" trains described herein.

Trains with distributed power systems can be operated in different modes. One mode is where all locomotives in the train operate at the same notch command. So if the lead locomotive is commanding motoring—N8, all units in the train will be commanded to generate motoring—N8 power. Another mode of operation is "independent" control. In this mode, locomotives or sets of locomotives distributed throughout the train can be operated at different motoring or braking powers. For example, as a train crests a mountaintop, the lead locomotives (on the down slope of mountain) may be placed in braking, while the locomotives in the middle or at the end of the train (on the up slope of mountain) may be in motoring. This is done to minimize tensile forces on the mechanical couplers that connect the railcars and locomotives. Traditionally, operating the distributed power system in "independent" mode required the operator to manually command each remote locomotive or set of locomotives via a display in the lead locomotive. Using the physics based planning model, train set-up information, on-board track database, on-board operating rules, location determination system, real-time closed loop power/brake control, and sensor feedback, the system is able to automatically operate the distributed power system in "independent" mode.

When operating in distributed power, the operator in a lead locomotive can control operating functions of remote locomotives in the remote consists via a control system, such as a distributed power control element. Thus when operating in distributed power, the operator can command each locomotive consist to operate at a different notch power level (or one consist could be in motoring and another could be in braking), wherein each individual locomotive in the locomotive consist operates at the same notch power. In an exemplary embodiment, with an exemplary embodiment of the present invention installed on the train, preferably in communication with the distributed power control element, when a notch power level for a remote locomotive consist is desired as recommended by the optimized trip plan, the exemplary embodiment of the present invention will communicate this power setting to the remote locomotive consists for implementation. As discussed below, the same is true regarding braking.

Exemplary embodiments of the present invention may be used with consists in which the locomotives are not contiguous, e.g., with 1 or more locomotives up front and others in the middle and/or at the rear for train. Such configurations are called distributed power, wherein the standard connection between the locomotives is replaced by radio link or auxiliary cable to link the locomotives externally. When operating in distributed power, the operator in a lead locomotive can control operating functions of remote locomotives in the consist via a control system, such as a distributed power control element. In particular, when operating in distributed power, the operator can command each locomotive consist to operate at a different notch power level (or one consist could be in motoring and other could be in braking), wherein each individual in the locomotive consist operates at the same notch power.

In an exemplary embodiment, with an exemplary embodiment of the present invention installed on the train, preferably in communication with the distributed power control element, when a notch power level for a remote locomotive consist is desired as recommended by the optimized trip plan, the exemplary embodiment of the present invention will communicate this power setting to the remote locomotive consists for implementation. As discussed below, the same is true regarding braking. When operating with distributed power, the optimization problem previously described can be enhanced to allow additional degrees of freedom, in that each of the remote units can be independently controlled from the lead unit. The value of this is that additional objectives or constraints relating to in-train forces may be incorporated into the performance function, assuming the model to reflect the in-train forces is also included. Thus, exemplary embodiments of the present invention may include the use of multiple throttle controls to better manage in-train forces as well as fuel consumption and emissions.

In a train utilizing a consist manager, the lead locomotive in a locomotive consist may operate at a different notch power setting than other locomotives in that consist. The other locomotives in the consist operate at the same notch power setting. Exemplary embodiments of the present invention may be utilized in conjunction with the consist manager to command notch power settings for the locomotives in the consist. Thus, based on exemplary embodiments of the present invention, since the consist manager divides a locomotive consist into two groups, namely, lead locomotive and trail units, the lead locomotive will be commanded to operate at a certain notch power and the trail locomotives are commanded to operate at another certain notch power. In an exemplary embodiment the distributed power control element may be the system and/or apparatus where this operation is housed.

Likewise, when a consist optimizer is used with a locomotive consist, exemplary embodiments of the present invention can be used in conjunction with the consist optimizer to determine notch power for each locomotive in the locomotive consist. For example, suppose that a trip plan recommends a notch power setting of 4 for the locomotive consist. Based on the location of the train, the consist optimizer will take this information and then determine the notch power setting for each locomotive in the consist. In this implementation, the efficiency of setting notch power settings over intra-train communication channels is improved. Furthermore, as discussed above, implementation of this configuration may be performed utilizing the distributed control system.

Furthermore, as discussed previously, exemplary embodiments of the present invention may be used for continuous corrections and re-planning with respect to when the train consist uses braking based on upcoming items of interest, such as but not limited to, railroad crossings, grade changes, approaching sidings, approaching depot yards, and approaching fuel stations, where each locomotive in the consist may require a different braking option. For example, if the train is coming over a hill, the lead locomotive may have to enter a braking condition, whereas the remote locomotives, having not reached the peak of the hill may have to remain in a motoring state.

Figure 10:
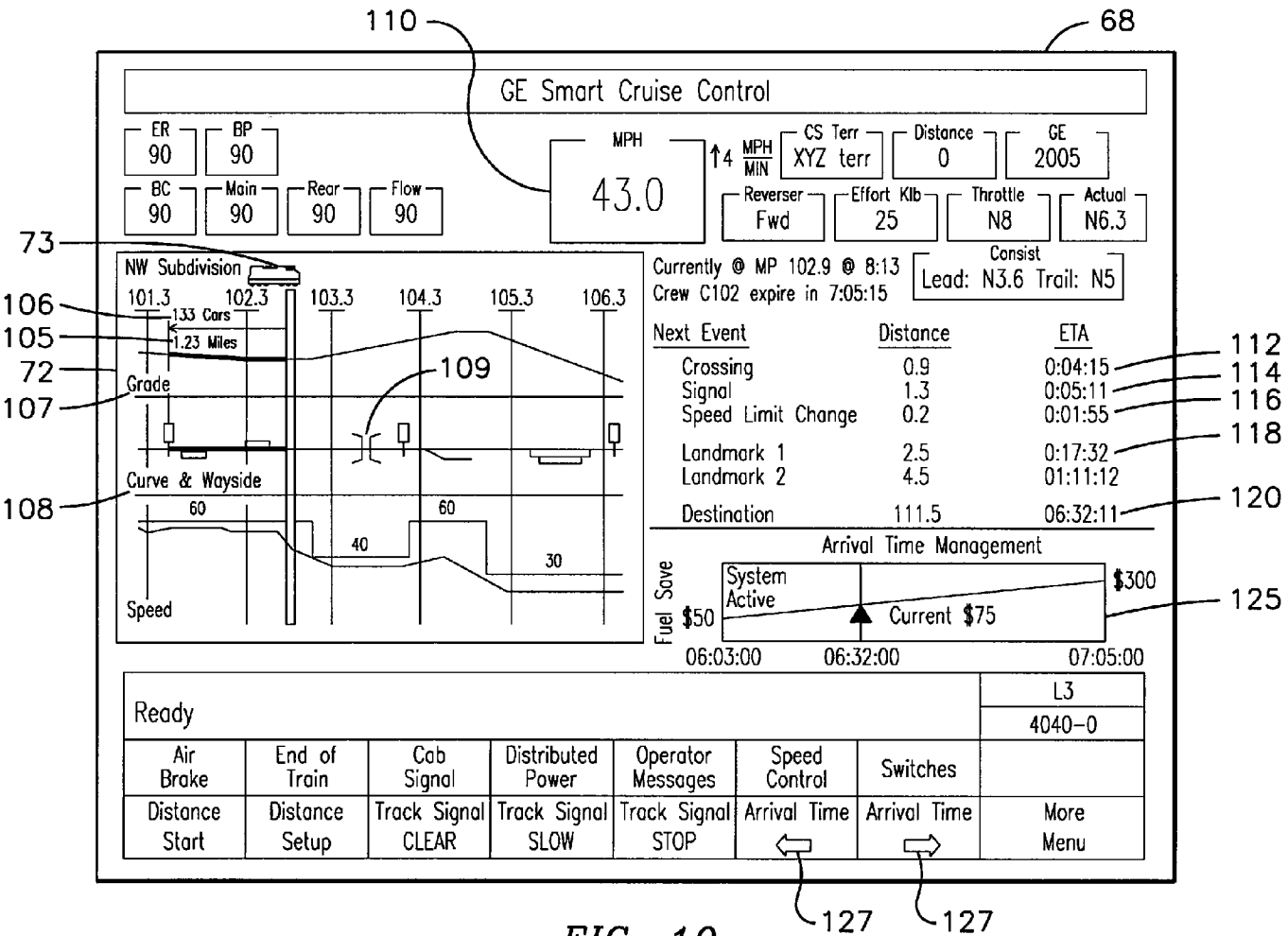
FIG. 10 depicts an exemplary illustration of a dynamic display for use by an operator.

FIGS. 8, 9, and 10 depict exemplary illustrations of dynamic displays for use by the operator. As shown in FIG. 10, a trip profile 72 is provided in the form of a rolling map 400. Within the profile a location 73 of the locomotive is provided. Such information as train length 105 and the number of cars 106 in the train is also provided. Display elements are also provided regarding track grade 107, curve and wayside elements 108, including bridge location 109, and train speed 110. The display 68 allows the operator to view such information and also see where the train is along the route. Information pertaining to distance and/or estimated time of arrival to such locations as crossings 112, signals 114, speed changes 116, landmarks 118, and destinations 120 is provided. An arrival time management tool 125 is also provided to allow the user to determine the fuel savings that is being realized during the trip. The operator has the ability to vary arrival times 127 and witness how this affects the fuel savings. As discussed herein, those skilled in the art will recognize that fuel saving is an exemplary example of only one objective that can be reviewed with a management tool. Towards this end, depending on the parameter being viewed, other parameters discussed herein can be viewed and evaluated with a management tool that is visible to the operator. The operator is also provided information about how long the crew has been operating the train. In exemplary embodiments time and distance information may either be illustrated as the time and/or distance until a particular event and/or location, or it may provide a total time.

Figure 11:
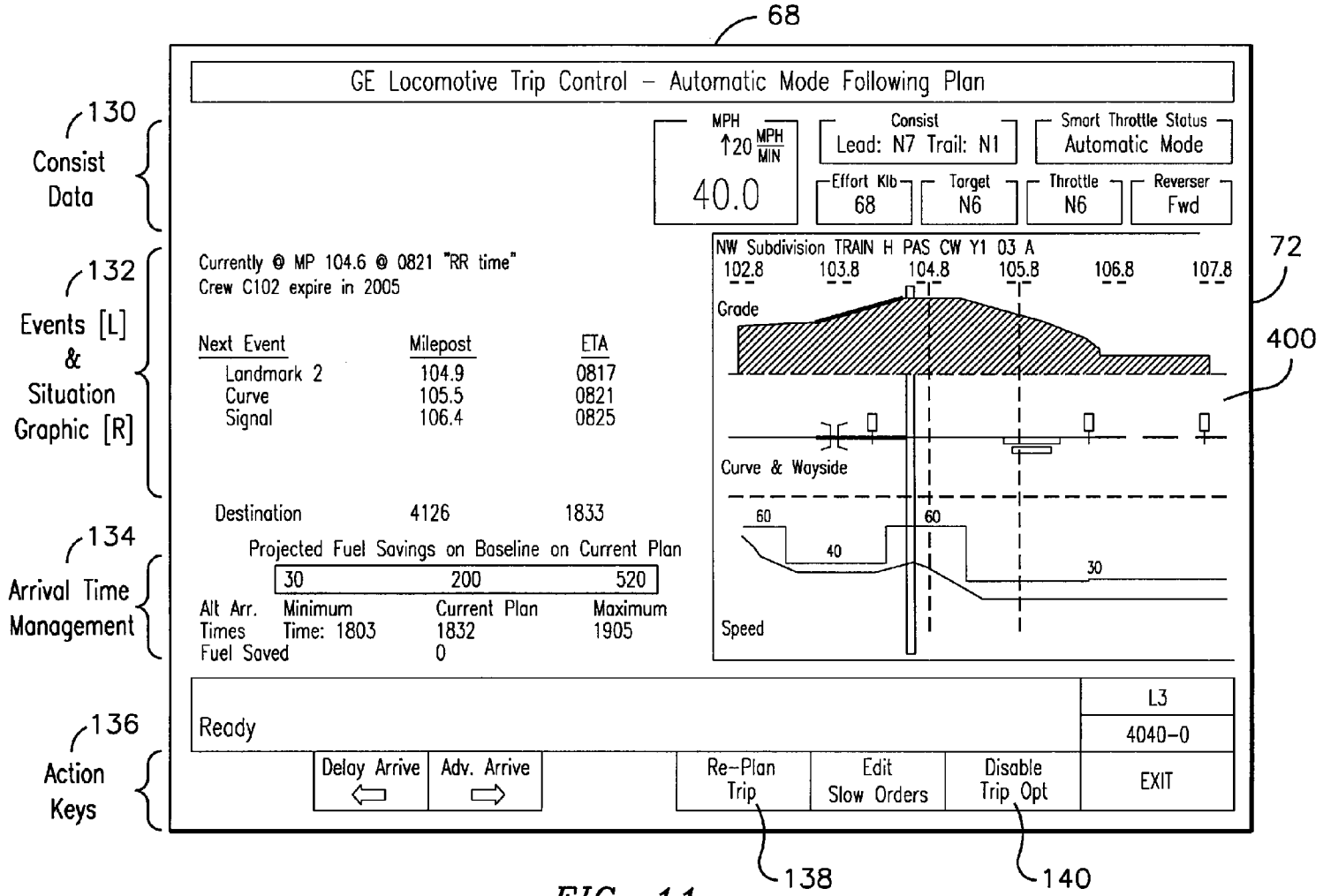
FIG. 11 depicts another exemplary illustration of a dynamic display for use by the operator.

As illustrated in FIG. 11, an exemplary display provides information about consist data 130, an events and situation graphic 132, an arrival time management tool 134, and action keys 136. Similar information as discussed above is provided in this display as well. This display 68 also provides action keys 138 to allow the operator to re-plan as well as to disengage 140 exemplary embodiments of the present invention.

Figure 12:
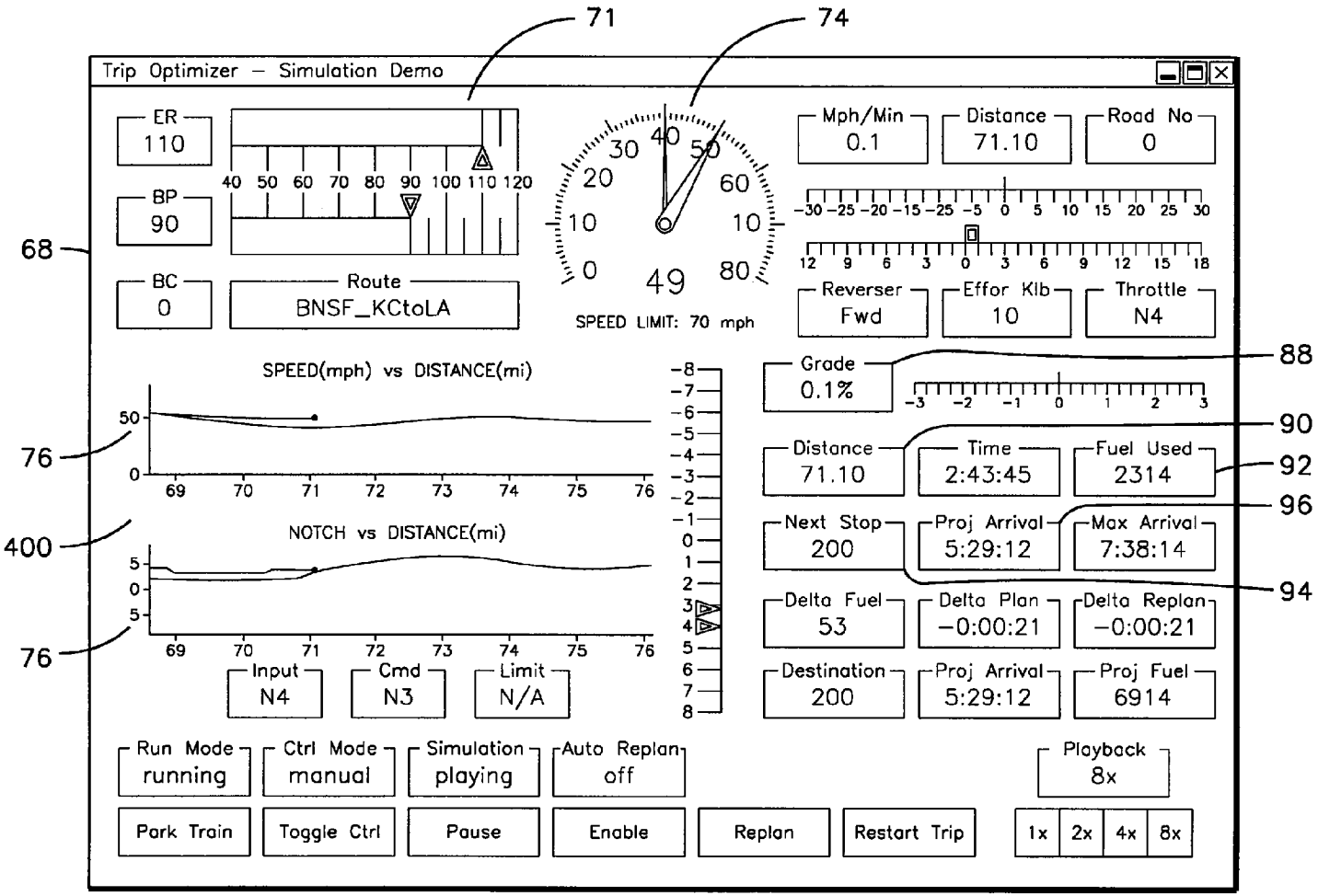
FIG. 12 depicts another exemplary illustration of a dynamic display for use by the operator.

FIG. 12 depicts another exemplary embodiment of the display. Data typical of a modern locomotive including airbrake status 71, analog speedometer with digital insert, or indicator, 74, and information about tractive effort in pounds force (or traction amps for DC locomotives) is visible. An indicator 74 is provided to show the current optimal speed in the plan being executed, as well as an accelerometer graphic to supplement the readout in mph/minute. Important new data for optimal plan execution is in the center of the screen, including a rolling strip graphic 76 with optimal speed and notch setting versus distance compared to the current history of these variables. In this exemplary embodiment, the location of the train is derived using the locator element. As illustrated, the location is provided by identifying how far the train is away from its final destination, an absolute position, an initial destination, an intermediate point, and/or an operator input.

The strip chart provides a look-ahead to changes in speed required to follow the optimal plan, which is useful in manual control, and monitors plan versus actual during automatic control. As discussed herein, such as when in the coaching mode, the operator can follow either the notch or speed suggested by exemplary embodiments of the present invention. The vertical bar gives a graphic of desired and actual notch, which are also displayed digitally below the strip chart. When continuous notch power is utilized, as discussed above, the display will simply round to the closest discrete equivalent. The display may be an analog display so that an analog equivalent or a percentage or actual horse power/tractive effort is displayed.

Critical information on trip status is displayed on the screen, and shows the current grade the train is encountering 88, either by the lead locomotive, a location elsewhere along the train, or an average over the train length. A distance traveled so far in the plan 90, cumulative fuel used 92, where the next stop is planned 94 (or a distance away therefrom), current and projected arrival time 96, and expected time to be at next stop are also disclosed. The display 68 also shows the maximum possible time to destination possible with the computed plans available. If a later arrival was required, a re-plan would be carried out. Delta plan data shows status for fuel and schedule ahead or behind the current optimal plan. Negative numbers mean less fuel or early compared to plan, positive numbers mean more fuel or late compared to plan, and typically trade-off in opposite directions (slowing down to save fuel makes the train late and conversely).

At all times, these displays 68 give the operator a snapshot of where he stands with respect to the currently instituted driving plan. This display is for illustrative purpose only as there are many other ways of displaying/conveying this information to the operator and/or dispatch. Towards this end, the information disclosed herein could be intermixed to provide a display different than the ones disclosed.

Figure 13:
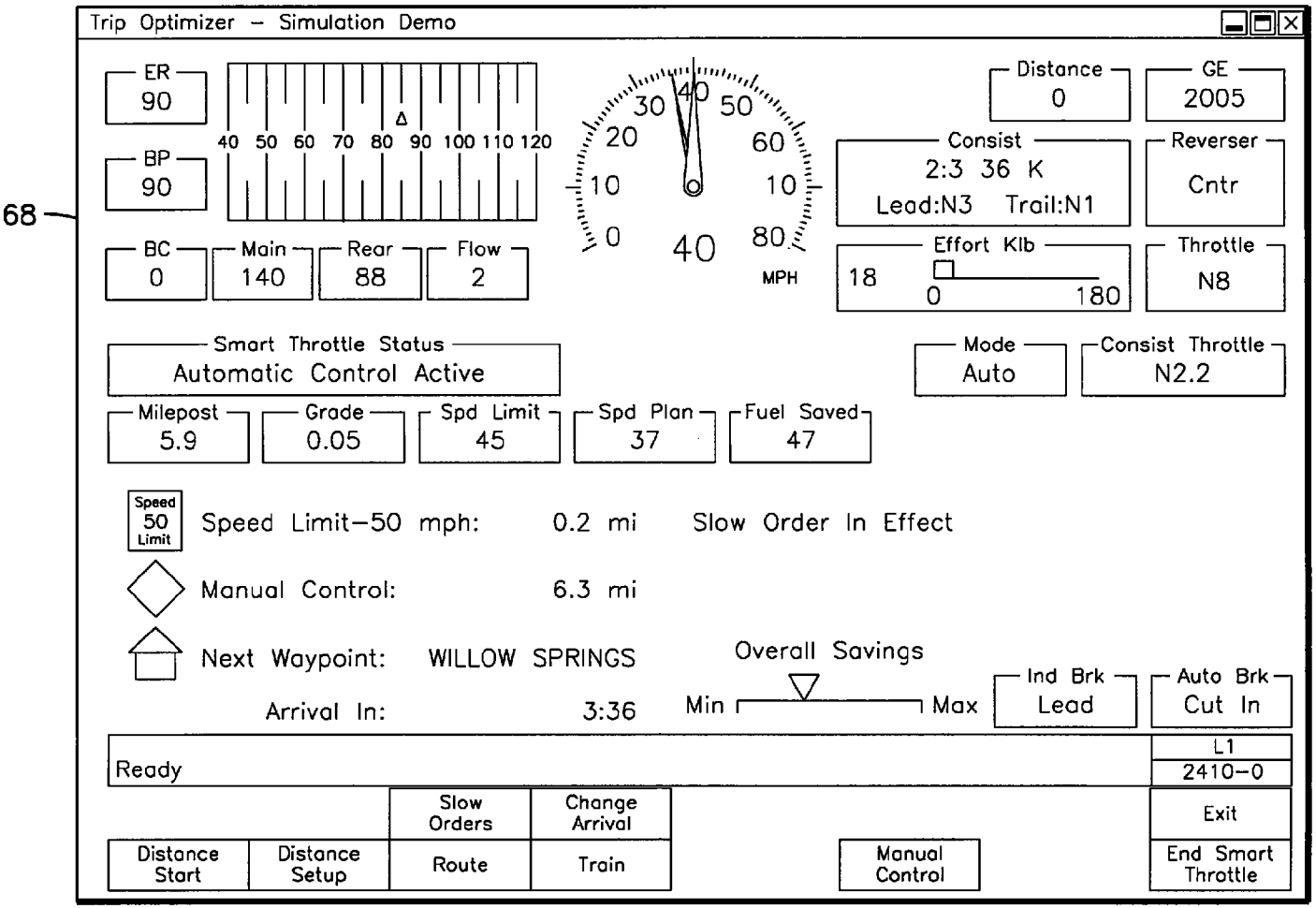
FIG. 13 depicts another exemplary illustration of a dynamic display for use by the operator.
Figure 14:
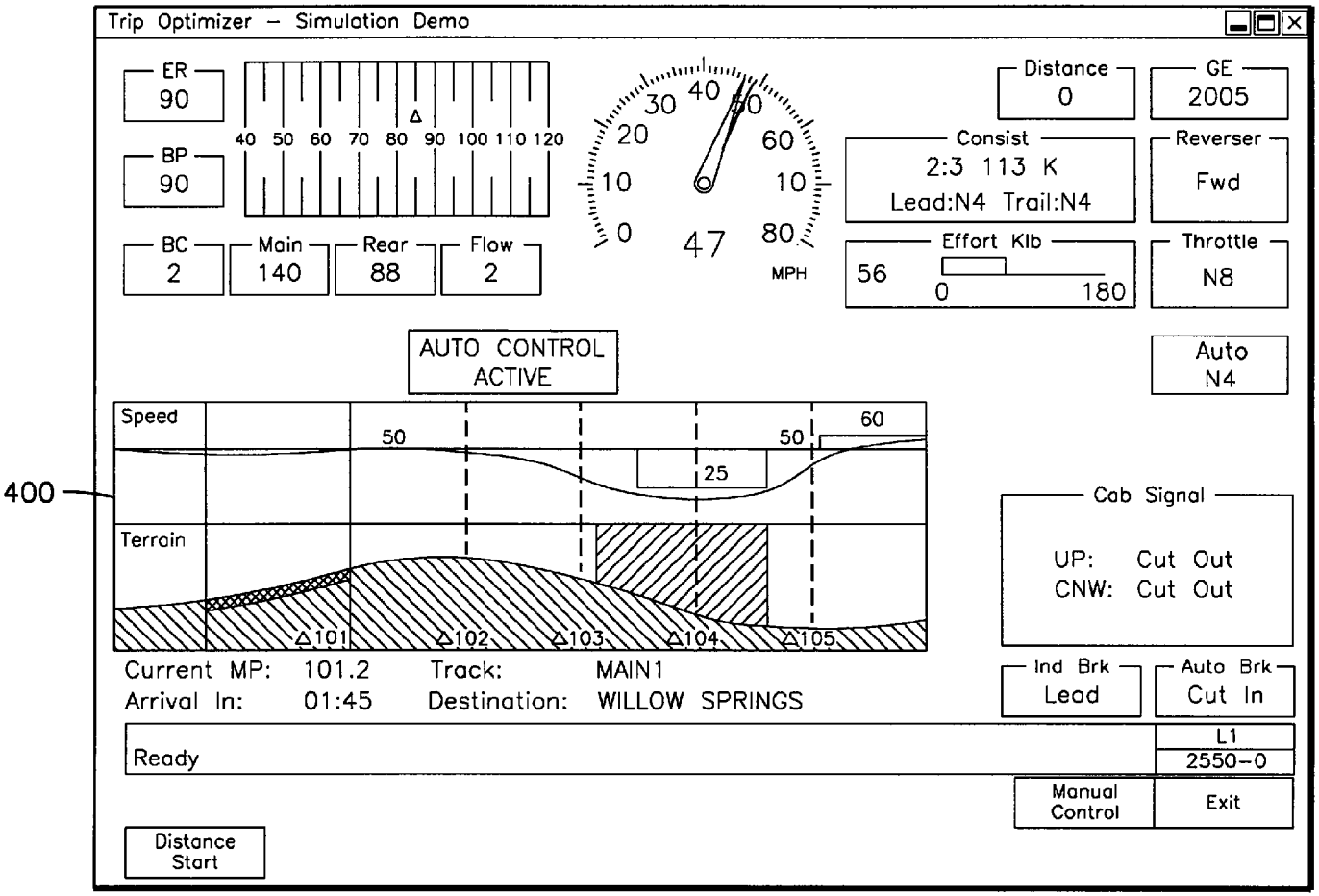
FIG. 14 depicts another exemplary illustration of a dynamic display for use by the operator.

FIG. 13 depicts another exemplary illustration of a dynamic display for use by the operator. In this display, the current location, grade, speed limit, plan speed and fuel saved are displayed as current numerical values rather than in graphical form. In this display, the use of an event list is used to inform the operator of upcoming events or landmarks rather than a rolling map or chart.

In an additional exemplary embodiment of the present invention, a method may be utilized to enter train manifest and general track bulletin information on the locomotive. Such information may be entered manually using the existing operating displays 68 or a new input device. Also, train manifest and general track bulletin information may be entered through a maintenance access point, using portable media or via portable test unit program. Additionally, such information may be entered through a wireless transfer through a railroad communications network, as another exemplary example. The amount of train manifest and general track bulletin information can be configured based upon the type of data entry method. For example, the per car load information may not be included if data entry is performed manually, but could be included if data entry is via wireless data transfer.

Regarding the information display for an exemplary embodiment of the trip optimizer, certain features and functions may be utilized by the operator. For example, a rolling map 400, as is illustrated in FIGS. 8-10, 12, 16, 17, 19, in which each data element is distinguishable from others, be may be utilized. Such a rolling map 400 may provide such information as a speed limit, whether it be a civil, temporary, turnout, signal imposed, work zones, terrain information and/or track warrant. The types of speed limits can be presented to be distinguishable from one another. Additionally, such a rolling map may provide trip plan speed information or actual speed, trip plan notch or actual notch, trip plan horsepower by the consist or the locomotive, trip plan tractive/brake effort or actual tractive/brake effort, and trip plan fuel consumption planned versus actual by any of the train, locomotive or locomotive consist. The information display may additionally display a list of events, such as is further illustrated in FIG. 13, instead of the rolling map, where such events may include a current milepost, list of events by an upcoming milepost, a list of events for alternate routes, or shaded events that are not on a current route, for example. Additionally, the information display may provide a scrolling function or scaling function to see the entire display data. A query function may also be provided to display any section of the track or the plan data.

The information display, in addition to those features mentioned above, may also provide a map with a variable setting of the x-axis, including expanded and compressed views on the screen, such as is illustrated in FIG. 15. For example, the first 3 miles (4.828 kilometers) 402 may be viewed in the normal view, while the next 10 miles (16.09 kilometers) 404 may be viewed in the compressed view at the end of the rolling map 400. This expanded and compressed view could be a function of speed (for example at low speeds short distances are visible in detail and high speeds longer distances are visible), as a function of the type of train, as a function of the terrain variations, as a function of activity (example grade crossings, signal lights etc). Additionally, as is illustrated in FIG. 16, the information display may show historical data for the trip by horsepower/ton, and show current fuel savings versus historical fuel savings.

Figure 17A:
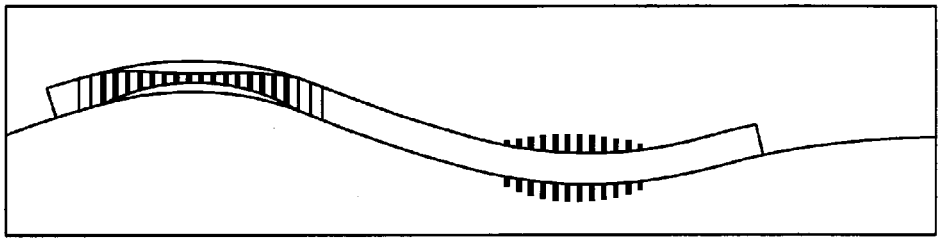
FIG. 17A depicts an exemplary illustration of a train state displayed on the dynamic display.
Figure 17B:
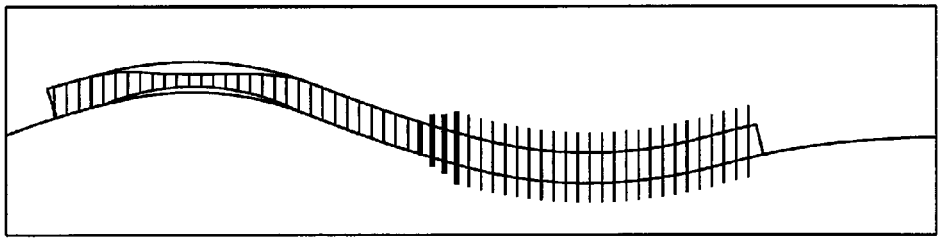
FIG. 17B depicts another exemplary illustration of a train state displayed on the dynamic display.
Figure 17C:
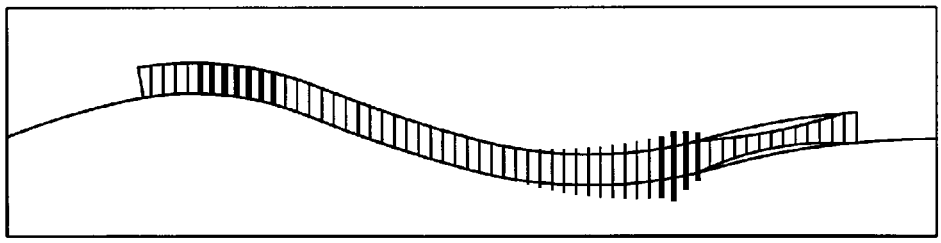
FIG. 17C depicts another exemplary illustration of a train state displayed on the dynamic display screen.
Figure 18:
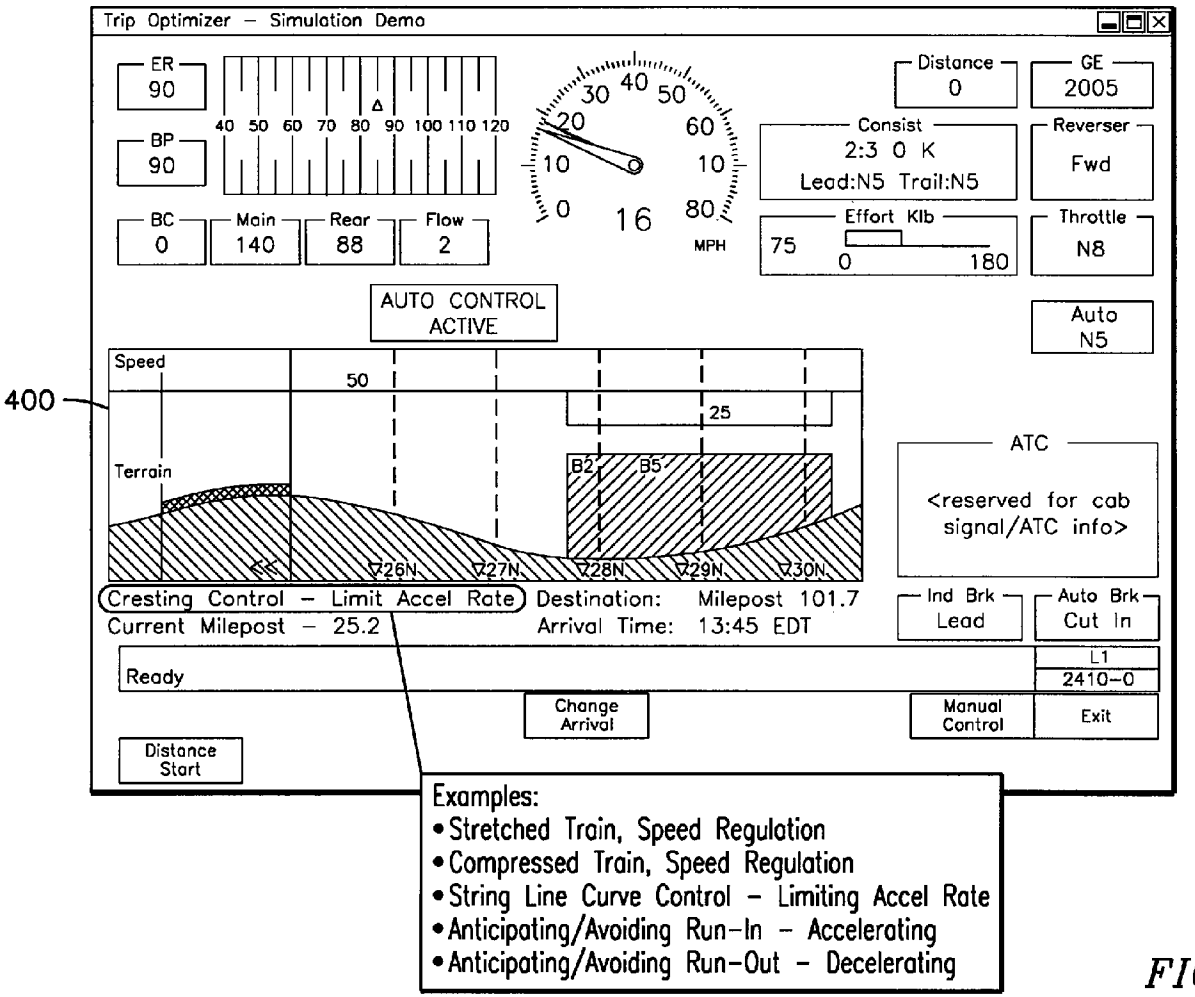
FIG. 18 depicts an exemplary illustration of the dynamic display being used as a training device.
Figure 19:
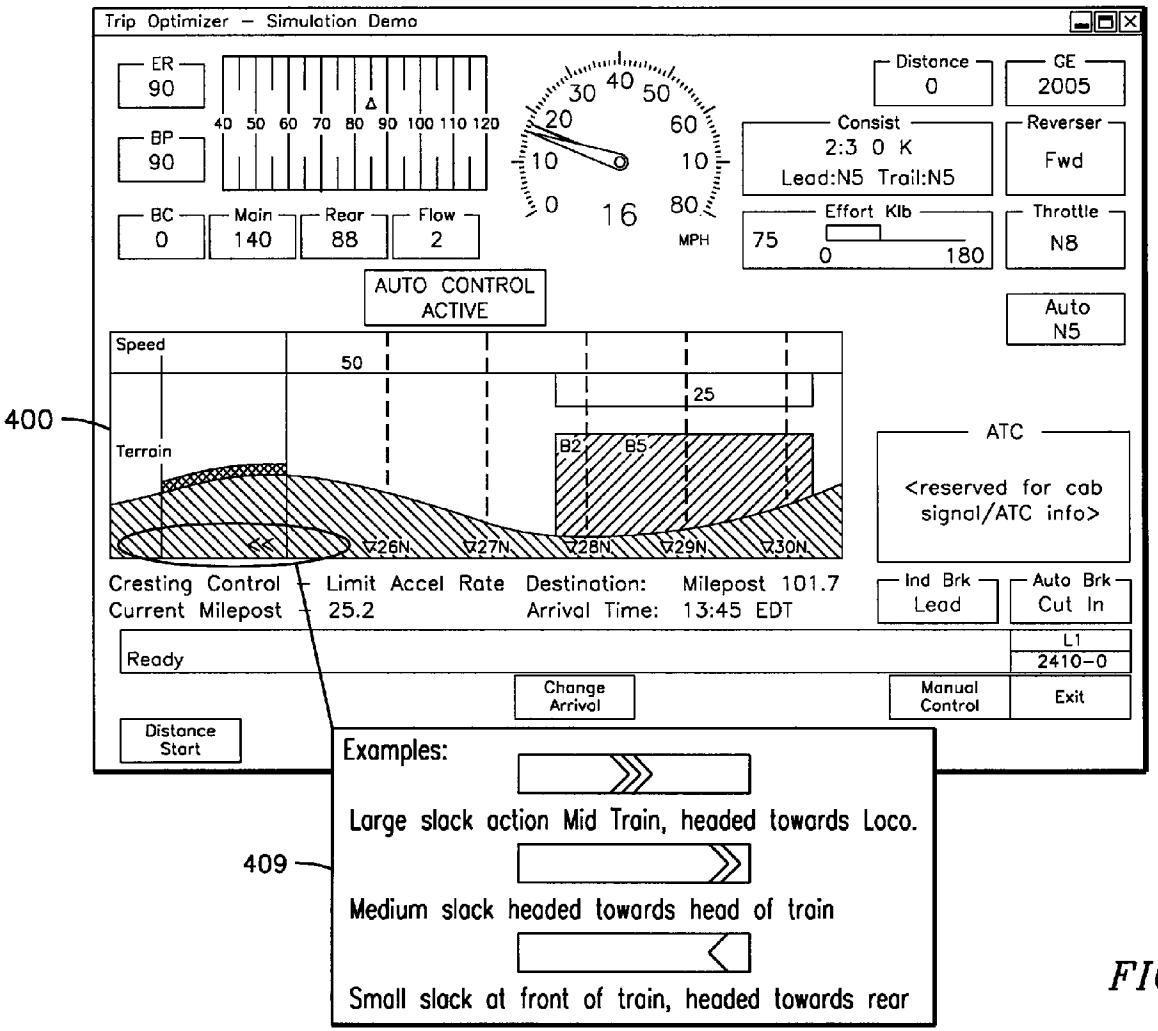
FIG. 19 depicts another exemplary illustration of the in-train forces being display on the dynamic display screen.

Additionally, as is further illustrated in FIGS. 17-19, the exemplary embodiment of the present invention may include a display of impending actions which form a unique set of data and features available on the display to the operator as a function of the trip optimizer. Such items may include, but are not limited to a unique display of tractive effort (TE)/buffer (Buff) forces in the train and the limit, a display of the point in the train where peak forces exist, a display of the "reasons" for the actions of the system. This information may be displayed at all times, and not just when the powered system is operating in an automatic and/or autonomous mode. The display may be modified as a function of the limit in effect, such as train forces, acceleration, etc.

For example, FIG. 17 discloses an exemplary visual train state graphic representing magnitude of a stretched or bunched train state. A train 42 is illustrated where part of the train 42 is in a valley 406 and another part is on a crest 408. FIG. 17A is a graphical representation that the stretch of the train over the crest is acceptable and that the bunch in the valley is also acceptable. FIG. 17B illustrates that due to braking too hard when leaving the valley, run-in, more specifically a situation when the cars on the train may run into each other, is building up in the train. FIG. 17C illustrates a situation where the train has been accelerated too quickly as it leaves the valley, creating a run-out, or pull between the cars, moving back through the train. The forces may be illustrated a plurality of ways including with an addition of color when the forces are increasing or by larger symbols where forces are increasing.

The graphics illustrated in FIGS. 17A-C may be included in the display, rolling map 400 disclosed in FIG. 18. The exemplary displays disclosed herein may also be used to train operators. For example, when operating in an automatic or autonomous mode, trip optimization information, including handling maneuvers, is displayed to the operator to assist the operator in learning. For a small portion of the mission, typically selected by the railroad owner, the trip optimizer will release control of the powered system to the operator for manual control. Data logs capturing information pertaining to the operator's performance. While in manual mode, train state information and associated handling information is still provided via the display to the operator.

FIG. 19 discloses a display illustrating an exemplary embodiment of an approach for displaying in-train forces to an operator. FIGS. 17A-C disclosed one exemplary approach to illustrate in-train forces. In another exemplary embodiment symbols 409 are provided where a number of the symbols 409 further illustrate the extent of in-train forces. Based on the direction of the symbols the direction may illustrate the direction of the forces.

In the exemplary embodiment of the invention, a display of information regarding arrival time management may be shown. The arrival time may be shown on the operational display and can be selectively shown by the customer. The arrival time data may be shown on the rolling map, such as but not limited to in a fixed time and/or range format. Additionally, it may be shown as a list of waypoints/stations with arrival times where arrival time may be wall-clock time or travel time. A configurable/selectable representation of the time, such as a travel time or wall-clock time or coordinated time universal (UTC) may be used. The arrival times and current arrival time may be limited by changing each waypoint. The arrival times may be selectively changed by the waypoints. Additionally, work/stop events with dwell times may be displayed, in addition to meet and pass events with particular times.

Additionally, the exemplary embodiment of the present invention may feature a display of information regarding fuel management, such as displaying travel time versus fuel trade off, including intermediate points. Additionally, the exemplary embodiment may display fuel savings versus the amount of fuel burned for the trip, such as is illustrated in FIG. 20.

The exemplary embodiment of the present invention additionally includes displaying information regarding the train manifest or trip information. An operating display will provide the ability for entry of data, modification of the data, confirmation of the data, alpha keypad on the screen, a configurable data set based on method of data entry, and inputting a route with a start and end location and intermediate point (i.e., waypoints). The waypoints may be based on a comprehensive list or intelligent pick list, based on the direction of the train, train ID, etc, a milepost, alpha searching, or scrolling a map with selection keys. Additionally, the operating display takes into account unique elements for locomotive consist modification, including power level/type, motoring status, dynamic brake status, isolated, the health of power (i.e., load pot), the number of axles available for power and braking, dead in tow, and air brake status.

Figure 21A:
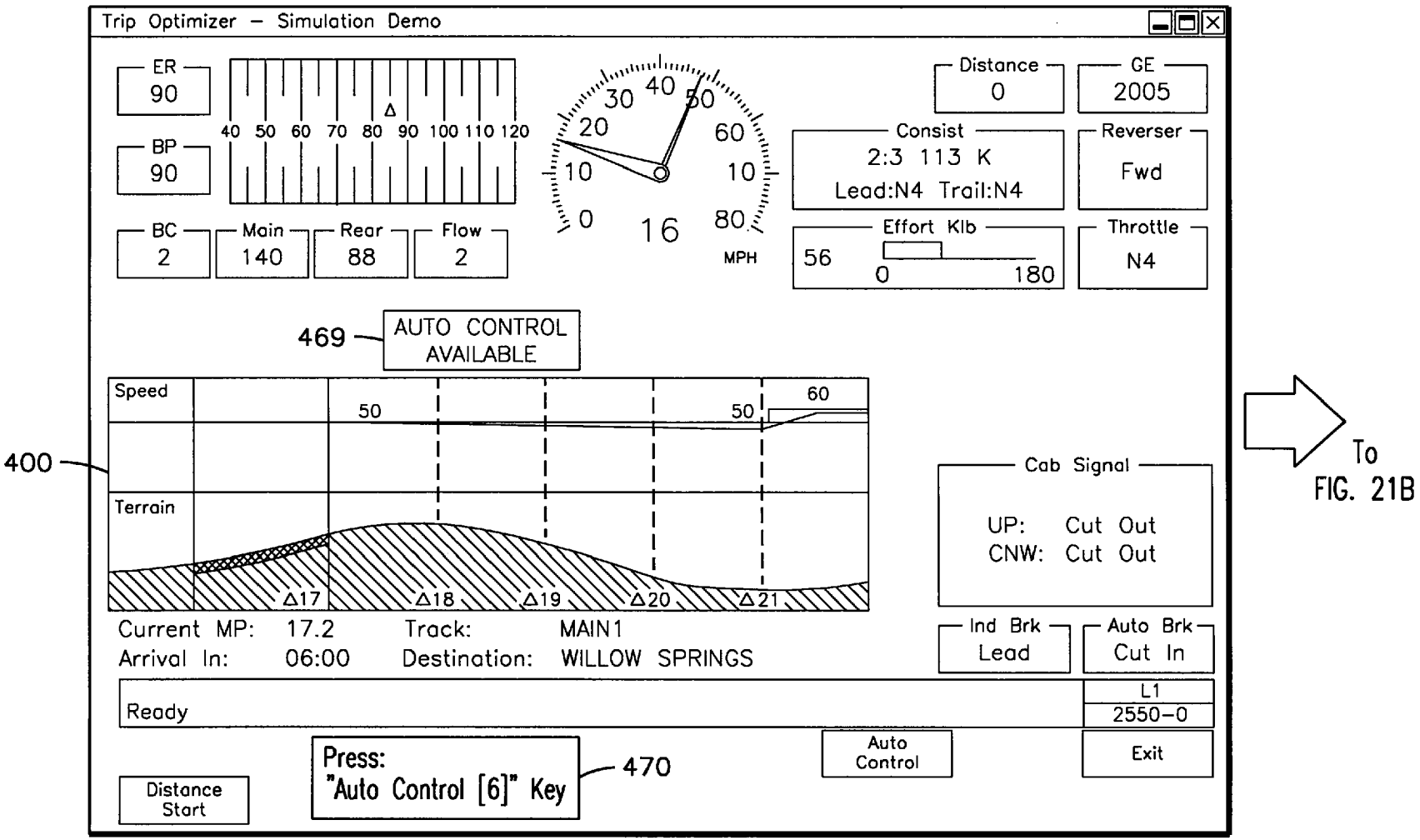
FIG. 21A depicts an exemplary illustration of a dynamic display screen notifying the operator when to engage the automatic controller.
Figure 21B:
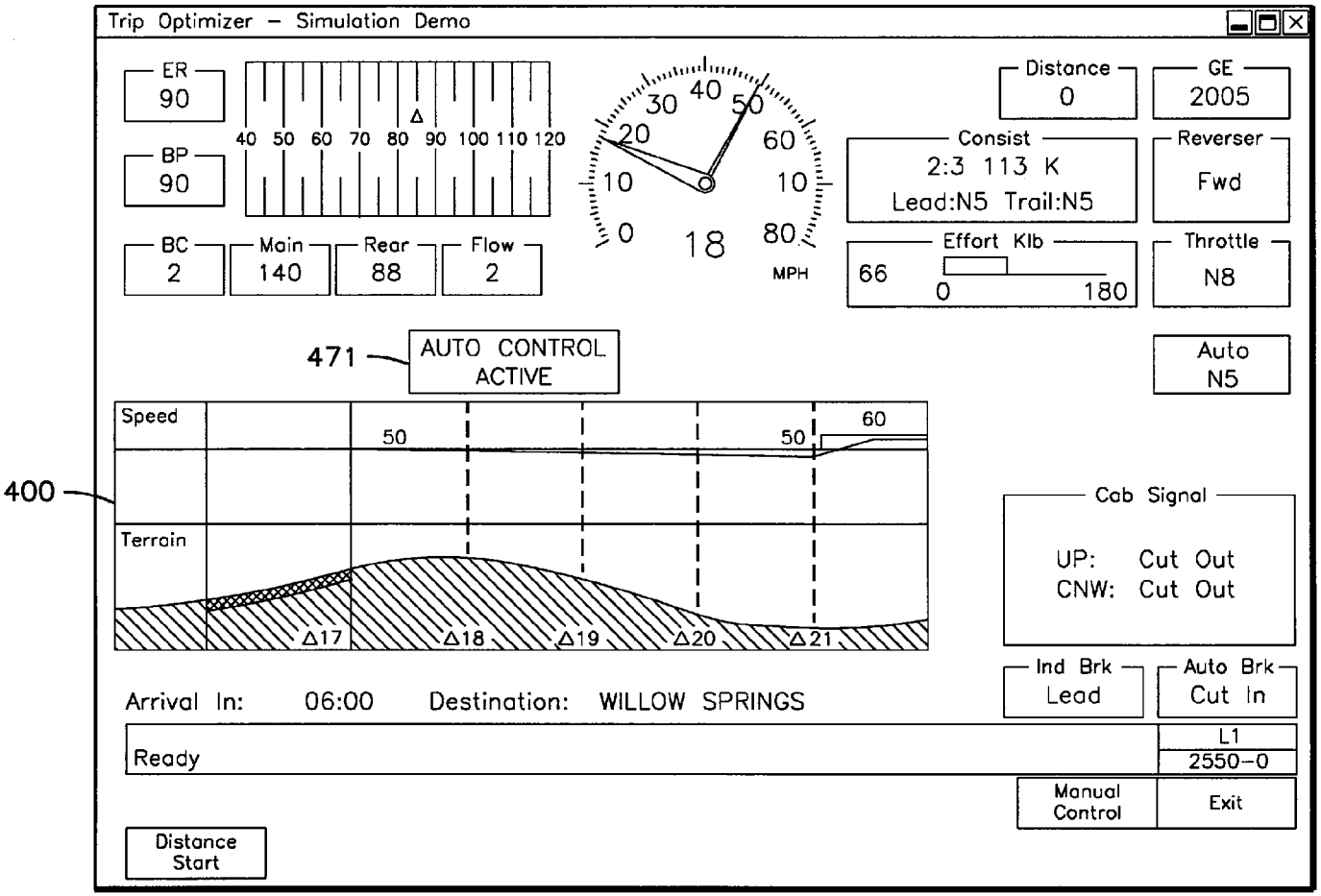
FIG. 21B depicts an exemplary illustration of a dynamic display screen notifying the operator when automatic controller is engaged.

The exemplary embodiment of the present invention also provides for changing control from manual control to automatic control (during motoring). FIG. 21A depicts an exemplary illustration of a dynamic display screen notifying the operator when to engage the automatic controller. A notice 469 is provided signifying that automatic control is available. In one embodiment, the operator initiates some action to let the system know that he/she desires the system to take control. Such action may include applying a key 470 to the screen or a hardware switch, or some other input device. Following this action, the system determines that the operator desires automatic control, and the operator may move the throttle to several positions selectively determined. For example, such positions may include idle/notch 1/notch 8 or any notch, and by positioning the throttle in one of these positions, the operator permits full control of power to the system. A notice is displayed to the operator regarding which notch settings are available. In another exemplary embodiment, if the throttle is able to be moved to any notch, the controller may choose to limit a maximum power that can be applied or operated at any power setting regardless of throttle handle position. As another exemplary example of selecting automatic control, the operator may select an engine speed and the system will use the analog trainlines or other trainline communications, such as but not limited to DB modem, to make power up to the available horsepower for that engine speed selected by the throttle notch or to full power regardless of the notch position. A relay, switch or electronic circuits can be used to break the master controller cam inputs into the system to allow full control over the throttle on the lead and trail consists. The control can use digital outputs to control and drive the desired trainlines. FIG. 21B depicts an exemplary illustration of the dynamic display screen after automatic control is entered. As illustrated, a notice 471 states that automatic control is active.

As disclosed above, similar information may be relayed to the operator when the powered system is remotely controlled so that the operator will know how to operate the remotely controlled powered system.

While the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A method comprising:

receiving terrain information at an operator control unit that is disposed off-board a vehicle system traveling along a route, the terrain information representative of terrain over which the route extends;

presenting the terrain information on the operator control unit to an operator of the operator control unit;

transmitting commands from the operator control unit to the vehicle system to control a velocity of the vehicle system, wherein the commands are based on the terrain information that is presented to the operator;

receiving the commands from the operator that is disposed remote from the vehicle system in order to control the velocity of the vehicle system in response to the terrain information that is received from the vehicle system;

wherein receiving the terrain information includes receiving the terrain information from the vehicle system, and wherein the terrain information is received from a memory disposed onboard the vehicle system.

2. The method according to claim 1, wherein the terrain information presented to the operator at least one of visually or audibly.

3. The method according to claim 1, wherein the vehicle system comprises at least one of a railway transportation system, a marine vessel, an off-highway vehicle, a transportation vehicle, or an agricultural vehicle.

4. The method of claim 1, wherein the terrain information represents upcoming terrain of the route that the vehicle system is traveling toward.

5. The method of claim 1, wherein receiving the terrain information and transmitting the commands is wirelessly performed using a wireless communication system.

6. The method of claim 1, wherein the commands are motoring commands transmitted to the vehicle system to control the velocity of the vehicle system based on the terrain information.

7. The method of claim 1, wherein the commands are braking commands transmitted to the vehicle system to control the velocity of the vehicle system based on the terrain information.

8. The method of claim 1, wherein receiving the terrain information and transmitting the commands is performed in a closed-loop feedback cycle.

9. The method of claim 1, wherein the operator control unit is a mobile device configured to be held by a single human operator.

10. The method of claim 1, wherein the terrain information represents at least one of grade or curvature of the terrain.

11. The method of claim 1, wherein receiving the terrain information and transmitting the commands are performed when the vehicle system is moving along the route.

12. A non-transitory computer readable medium having a computer software code for operating within a processor for operating a remotely controlled vehicle system from an operator control unit disposed off-board the vehicle system, the computer software code comprising one or more computer software modules for:

receiving terrain information at the operator control unit that is representative of a terrain over which a route extends that the vehicle system is traveling along;

presenting the terrain information on the operator control unit to an operator of the operator control unit;

transmitting commands from the operator control unit to control a velocity of the vehicle system, wherein the commands are based on the terrain information;

wherein the one or more computer software modules are configured to receive the terrain information from the vehicle system in order to control the velocity of the vehicle system;

wherein the one or more computer software modules are configured to communicate the terrain information from the vehicle system to the operator control unit, and wherein the terrain information is received from a memory disposed onboard the vehicle system.

13. The computer software code according to claim 12, wherein the one or more computer software modules present the terrain information to the operator at least one of visually or audibly.

14. The computer software code according to claim 12, wherein the vehicle system comprises at least one of a railway transportation system, a marine vessel, an off-highway vehicle, a transportation vehicle, or an agricultural vehicle.

15. The computer software code of claim 12, wherein the terrain information represents upcoming terrain of the route that the vehicle system is traveling toward.

16. The computer software code of claim 12, wherein the one or more computer software modules are configured to wirelessly receive the terrain information and wirelessly transmit the commands.

17. The computer software code of claim 12, wherein the terrain information represents at least one of grade or curvature of the terrain.

18. The computer software code of claim 12, wherein the one or more computer software modules are configured to receive the terrain information and transmit the commands when the vehicle system is moving along the route.

19. A system comprising:

an operator control unit disposed off-board a powered vehicle system moving along a route, the operator control unit for receiving terrain information that is representative of terrain over which a route extends that the vehicle system is traveling along;

wherein the operator control unit is configured to present the terrain information to an operator of the operator control unit;

wherein the operator control unit is configured to formulate and transmit commands to control a velocity of the vehicle system that are based on the terrain information;

Wherein the vehicle system is configured to receive the commands from the operator that is disposed remote from the vehicle system in order to control the velocity of the vehicle system in response to the terrain information that is received from the vehicle system;

Wherein the operator control unit configured to receive the terrain information includes receiving the terrain information from the vehicle system, and Wherein the terrain information is received from a memory disposed onboard the vehicle system.

20. The system of claim 19, wherein the operator control unit includes a display for visually presenting the terrain information to the operator.

21. The system of claim 19, wherein the terrain information that is received by the operator control unit represents upcoming terrain of the route that the vehicle system is traveling toward.

22. The system of claim 19, further comprising a wireless communication system for wirelessly receiving the terrain information from the vehicle system and for wirelessly transmitting the commands to the vehicle system from the operator control unit to the vehicle system.

23. The system of claim 19, wherein the operator control unit is configured to transmit motoring commands to the vehicle system to control the velocity of the vehicle system based on the terrain information.

24. The system of claim 19, wherein the operator control unit is configured to transmit braking commands to the vehicle system to control the velocity of the vehicle system based on the terrain information.

25. The system of claim 19, wherein the operator control unit is configured to receive the terrain information from the vehicle system and to transmit the commands to the vehicle system in a closed-loop feedback cycle.

26. The system of claim 19, wherein the operator control unit is a mobile device for being held by a single human operator.

27. The system of claim 19, wherein the operator control unit is configured to transmit the commands to control movement of a rail vehicle as the vehicle system.

28. The system of claim 19, wherein the terrain information represents at least one of grade or curvature of the terrain.

29. The system of claim 19, wherein the operator control unit is configured to receive the terrain information from the vehicle system and to transmit the commands to control the velocity of the vehicle system when the vehicle system is moving along the route.

* * * * *